US006263839B1

(12) United States Patent
Hoshiba et al.

(10) Patent No.: US 6,263,839 B1
(45) Date of Patent: Jul. 24, 2001

(54) ENGINE OVERHEAT DETECTION SYSTEM

(75) Inventors: Akihiko Hoshiba; Kazuhiro Nakamura; Yasuo Suganuma, all of Hamamatsu (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/324,789

(22) Filed: Jun. 3, 1999

(30) Foreign Application Priority Data

Mar. 6, 1998 (JP) ..... 10-154611

(51) Int. Cl.[7] ..... F01P 7/14

(52) U.S. Cl. ..... 123/41.08; 123/41.15; 440/88

(58) Field of Search ..... 123/41.15, 41.08; 374/144; 440/88

(56) References Cited

U.S. PATENT DOCUMENTS

| | | | | |
|---|---|---|---|---|
| 4,260,011 | * | 4/1981 | Brown | 165/35 |
| 4,459,951 | | 7/1984 | Tobinaga et al. | 123/198 DC |
| 4,562,801 | | 1/1986 | Koike | 123/196 S |
| 4,695,822 | | 9/1987 | Furukawa | 340/53 |
| 4,708,669 | | 11/1987 | Kanno et al. | 440/1 |
| 4,790,279 | | 12/1988 | Tobinaga et al. | 123/417 |
| 4,951,624 | | 8/1990 | Hirano | 123/198 D |
| 4,951,640 | | 8/1990 | Hirukawa et al. | 123/335 |
| 4,965,549 | | 10/1990 | Koike | 340/516 |
| 4,966,115 | | 10/1990 | Ito et al. | 123/418 |
| 5,309,882 | | 5/1994 | Hoshiba et al. | 123/339 |
| 5,769,055 | | 6/1998 | Motose et al. | 123/478 |
| 5,782,659 | * | 7/1998 | Motose | 440/1 |
| 5,788,547 | | 8/1998 | Ozawa et al. | 440/89 |
| 5,797,775 | | 8/1998 | Ozawa et al. | 440/1 |
| 5,827,150 | | 10/1998 | Mukumoto | 477/101 |
| 5,970,951 | | 10/1999 | Ito | 123/335 |
| 6,015,317 | | 1/2000 | Hoshiba et al. | 440/1 |
| 6,068,528 | | 5/2000 | Suzuki | 440/1 |

* cited by examiner

*Primary Examiner*—Willis R. Wolfe
*Assistant Examiner*—Katrina B. Harris
(74) *Attorney, Agent, or Firm*—Knobbe, Martens, Olson & Bear, LLP

(57) ABSTRACT

An improved overheat detection system for an engine having at least one coolant jacket which is drained of coolant when the engine is not running. The coolant jacket has an inlet portion into which the coolant is supplied and an outlet portion from which the coolant is discharged during the engine is running. In one feature of this invention, the overheat detection system has a sensor for sensing a temperature associated with the coolant jacket at an aft part of the coolant jacket including the outlet portion. In another feature of this invention, the overheat detection system has at least two sensors, one is positioned at a fore part of the coolant jacket including the inlet portion and another is positioned downstream of the former sensor, and both sensors for sensing each temperature associated with the coolant jacket. The overheat detection system is arranged to output an overheat signal in the event the temperature sensed by the sensor or at least one of the sensors is above a predetermined temperature.

20 Claims, 17 Drawing Sheets

ENGINE OVERHEAT DETECTION SYSTEM

BACKGROUND OF THE INVENTION

1. Field of the Invention

This invention relates to an engine overheat detection system and more particularly to an improved engine overheat detection system that is most suitable to a marine engine.

2. Description of Related Art

Watercraft powered by inboard or outboard motors typically include an electrical system. The motor includes a water propulsion device which is powered by an internal combustion engine. As is well known, an ignition system is utilized to fire one or more ignition elements corresponding to each combustion chamber of the engine, igniting the air and fuel mixture in each combustion chamber of the engine.

These engines commonly include a liquid cooling system. Liquid coolant in the form of water in which the watercraft is operating is supplied to various cooling passages or jackets associated with the engine. In some instances, the cooling system is arranged such that the coolant drains from the coolant jackets when the engine is stopped.

In order to prevent engine overheating, an overheat detection system may be associated with the engine. The detection system includes a sensor for sensing the temperature of the engine. The output of the sensor may be used by an engine control unit to shut off the engine by disabling the ignition system.

This system has the drawback that at certain times a condition of engine overheat may be indicated when in fact the engine is not in an overheat condition. This drawback is likely to happen particularly in connection with an engine that operates on a four stroke principle. Because such a four stroke engine has an oil pan therein for lubrication and lubricant contained in this oil pan tends to accumulate much heat during the engine operation.

Referring to FIG. 1, when the engine is operating normally and coolant is in the water jacket(s), the temperature inside the water jacket Tw remains lower than a predetermined high temperature or threshold temperature Tlim (85° C. in FIG. 1). When the engine is shut off, however, the coolant drains from the jacket. In addition, the temperature To of the lubricant contained in the oil pan is still high for some time after the engine is stopped. Because the lubricant temperature To is around 130° C. when the engine is running and the temperature To is hard to fall down. Since no coolant remains in the water jacket and the lubricant temperature To is high, the temperature in the jacket rises immediately after the engine has been stopped. The temperature may rise to a point well above the predetermined high temperature Tlim. Then, with the lubricant temperature To falling down, the temperature inside the water jacket Tw falls back below the temperature Tlim.

If the engine is subsequently restarted before the temperature in the jacket Tw falls back below the temperature Tlim, the overheat detection system will indicate that the engine is overheated. This is due primarily because coolant is not yet being supplied to the cooling jacket(s).

In order to prevent the wrong determination of overheat from being occurring when the engine is restarted immediately after being stopped, one idea may be proposed wherein no overheat detection is made during a predetermined time after the engine is started. FIG. 2 shows a flowchart of an overheat detection routine in accordance with this idea as an example.

Immediately after the engine is started, the program goes to a step S1 and checks if an overheat sensor (thermal switch) is on or off. If it is on, i.e., the temperature inside the water jacket Tw is higher than the predetermined high temperature Tlim, the program goes to a step S2 to determine if the engine has been just started or not. This state is represented by that the engine speed is less than 2000 rpm. If this is negative, the program goes to a step S3 and prevents an overheat signal from being output for 20 seconds. Then, the program goes to a step S4 to check again with the overheat sensor if it is still on. If it is positive, the program permits to output an overheat signal in a step S6. Meanwhile, if the engine speed is equal to or greater than 2000 rpm in the step S2, the program goes to a step S5 and prevents the overheat signal from being output for 90 seconds. Thus, the wrong determination of overheat is prevented. The method and system for this overheat detection will be described more in detail later.

However, another problem arises if the prevention time (indicated as Ts in FIG. 1) is relatively long. That is, in the event an actual overheat happens, no overheat signal is provided during the prevention time and the engine must operates under this overheat condition for a while.

It is, therefore, a principal object to provide an improved engine overheat detection system which overcomes the above-stated problems.

SUMMARY OF THE INVENTION

This invention is adapted to be embodied in an internal combustion engine. The engine has a cooling system provided that includes at least one coolant jacket into which coolant is supplied for cooling at least a portion of the engine, the coolant jacket has an inlet portion through which the coolant is induced and an outlet portion from which the coolant is discharged during the engine is running. The cooling system is arranged to drain the coolant from the coolant jacket when the engine is not running, In accordance with one aspect of this invention, an overheat detection system comprises a sensor for sensing a temperature associated with the coolant jacket to output a temperature signal. The sensor is positioned at an aft part of the coolant jacket including the outlet portion. Means is provided for determining an overheat of the engine based upon the temperature signal from the sensor when a sensed temperature exceeds a predetermined temperature to output an overheat signal.

In accordance with another aspect of this invention, the overheat detection system comprises at least two sensors for sensing temperatures associated with the coolant jacket to output temperature signals. One of the sensors is positioned at a fore part of the coolant jacket including the inlet portion. Another one of the sensors is positioned downstream of the one sensor. Means is provided for determining an overheat of the engine based upon the temperature signals from the sensors when at least one of sensed temperatures exceeds a predetermined temperature.

BRIEF DESCRIPTION OF THE DRAWINGS

These and other features of this invention will now be described with reference to the drawings of preferred embodiments which are intended to illustrate and not to limit the invention.

As described above.

FIG. 1 is a graphical view showing the coolant jacket temperature, engine speed and lubricant temperature versus time when engine is running, then stopped and restarted.

FIG. 2 is a flowchart showing one idea of an overheat detection as an example.

DETAILED DESCRIPTION OF THE PREFERRED EMBODIMENTS OF THE INVENTION

The present invention is an overheat detection system. Preferably, the system is associated with an engine used in a marine application, such as for powering an outboard motor. Those of skill in the art will appreciate that the overheat detection system of the present invention may be used with engines adapted for use in other applications.

Figure 3:
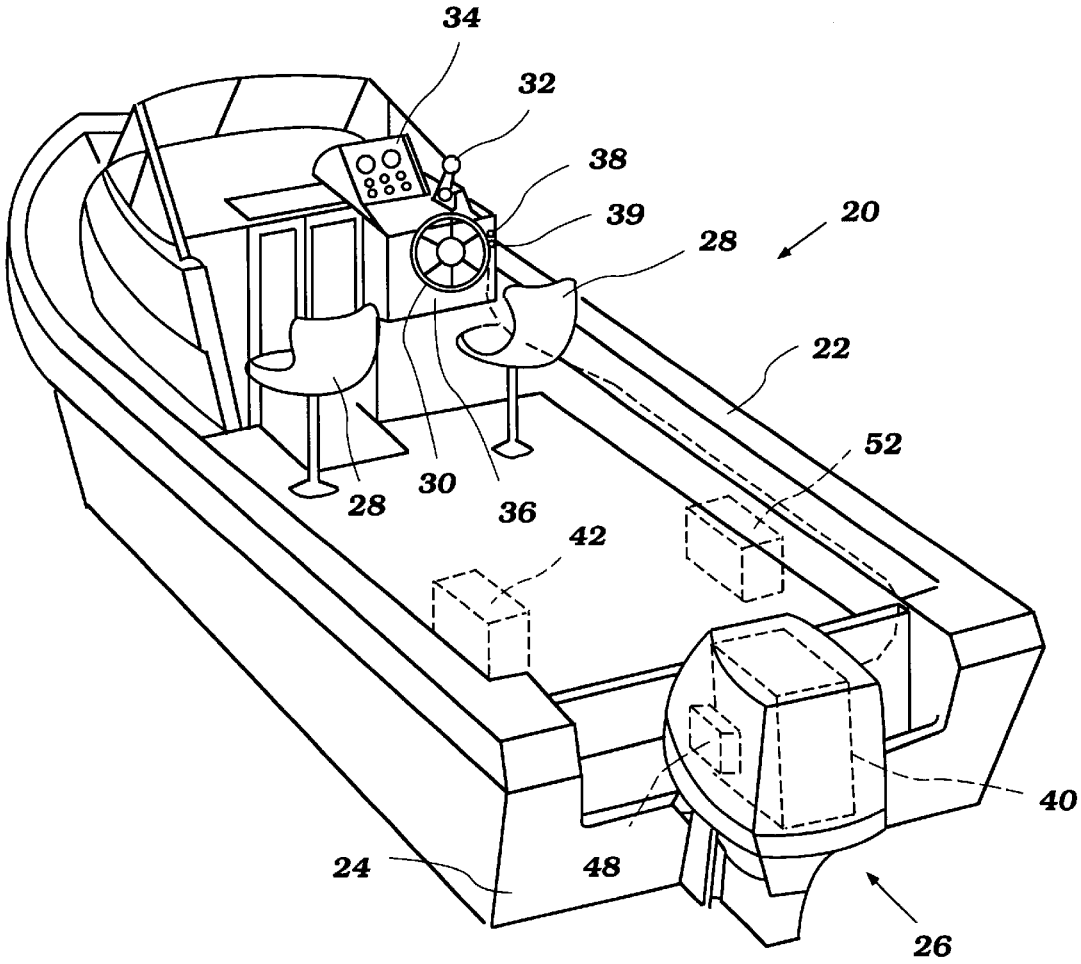
FIG. 3 is a perspective view showing a watercraft propelled by an outboard motor.

Referring to FIG. 3, there is illustrated a watercraft 20. The watercraft 20 illustrated is a power boat, may comprise any number of other types of crafts. The watercraft 20 has a hull 22 with a transom portion 24 to which is mounted an outboard motor 26. The outboard motor 26 is utilized to propel the watercraft 20. The motor 26 has a water propulsion device such as a propeller (not shown). An impeller for a water jet system is of course practicable as the water propulsion device. As known to those skilled in the art, the motor 26 may also be of the inboard type.

When of the outboard variety, the motor 26 is connected to the watercraft 20 in a manner which allows it to pivot up and down in a vertical plane ("trimming" and "tilting") and rotate left and right in a horizontal plane ("steering") in a manner well known to those skilled in the art.

The watercraft 20 illustrated includes a pair of seats 28. One of the seats 28 is preferably positioned near a steering wheel 30. The steering wheel 30 is connected remotely to the outboard motor 26 for effectuating movement of the motor left and right for steering the craft. Additionally, a throttle and shift control such as a control lever 32 is preferably positioned near the steering wheel 30. The control lever 32 is for use in controlling the speed of the watercraft 20 by changing the speed of the engine powering the motor 26. The lever 32 simultaneously serves as a shift control lever for controlling the position of a transmission (not shown) associated with the propeller of the motor 26. Such transmissions are well known, and generally permit the motor 26 to drive in forward, reverse and neutral states.

A control panel 34 is preferably provided near the steering wheel 30, the control panel 34 having one or more gauges, meters or other displays for displaying various information to the user of the watercraft 20. These displays may display watercraft speed and the like. A switch panel 36 is also provided near the steering wheel 30. The switch panel 36 preferably includes one or more switches or controls, such as a main switch 38 and a kill switch 39. Both of the main switch 38 and the kill switch are formed with mechanical contacts.

Referring still to FIG. 3, the propeller is powered by an engine 40. The engine 40 is preferably mounted within a cowling of the motor 26 and operates on a four stroke principle. Thus, the engine 40 has an oil pan (not shown) therein. The engine 40 may be arranged in a variety of configurations, such as in-line, "V" or opposed, may operate on a two-stroke crankcase compression principle, and be of the rotary, reciprocating piston or other type. In this embodiment, the engine 40 has in-line four cylinders (and thus four combustion chambers) each having a piston reciprocally mounted therein and attached to a crankshaft and operates on a four-stroke principle. The first and forth cylinders operates on the same phase, while the second and third cylinders operates on the same phase. However, the phases of the former and latter groups are shifted with 180 degrees relative to each other group. The engine 40 is oriented within the cowling so that the crankshaft is generally vertically extending and in driving relation with the propeller of the motor 26.

The details of the engine 40 are not described herein and are well known to those of skill in the art. In general, the engine 40 includes a fuel supply system for supplying fuel from a fuel source, such as a fuel tank 42, to each combustion chamber of the engine 40. The engine 40 also includes an induction system for admitting air charge to each combustion chamber. An exhaust system routes exhaust of combustion from the engine 40 to a point external to the motor 26. The engine 40 is generally also provided with a lubricant pump, a water supply pump, an alternator (these are not shown) and other components necessary for its operation.

The engine 40 includes an ignition system and ignition control for initiating combustion of the air and fuel mixture supplied to each combustion chamber. This ignition system includes an ignition element associated with each cylinder of the engine. Preferably, and referring to FIG. 4, the ignition elements comprise at least one spark plug 44*a–d* associated with each cylinder (spark plug 44*a* corresponding to a first cylinder, spark plug 44*b* corresponding to a second cylinder, spark plug 44*c* corresponding to a third cylinder, and spark plug 44*d* corresponding to a fourth cylinder). As described in more detail below, a firing mechanism is associated with the spark plugs 44*a–d* for inducing a spark across a gap each spark plug 44*a–d* in order to initiate ignition of the fuel and air mixture within a combustion chamber or cylinder. In addition, an ignition control system is provided for controlling the firing mechanism.

Figure 4:
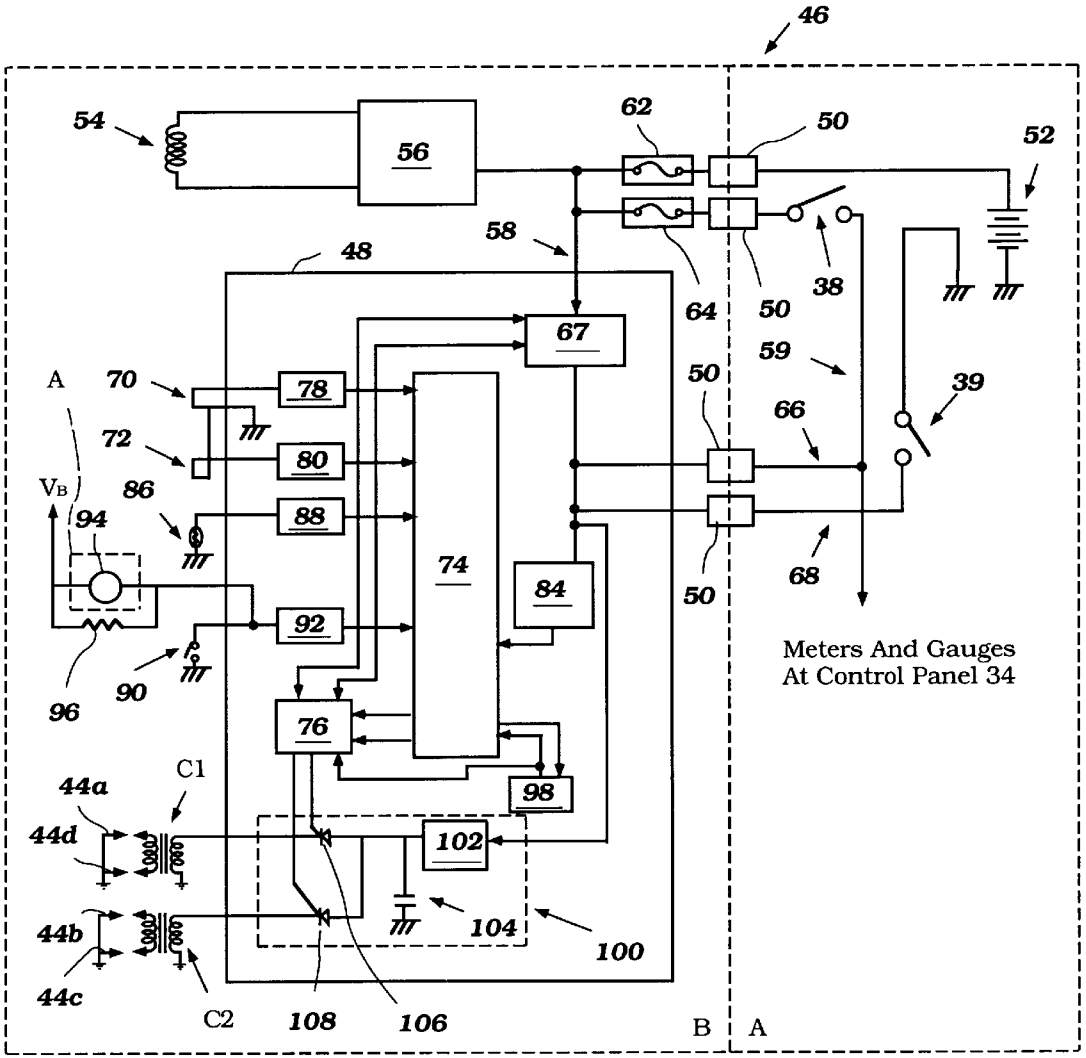
FIG. 4 is a circuit diagram showing an electrical system of the outboard motor illustrated in FIG. 3, the electrical system including an ignition control.

FIG. 4 illustrates an electrical system 46 associated with the watercraft 20 and the outboard motor 26. The electrical system 46 includes an ignition control circuit 48. In FIG. 4, area A denotes those components of the electrical system 46 which are positioned in the hull 22 of the watercraft 20, while area B denotes those components which are associated with the motor 26.

As the motor 26 is detachable from the watercraft 20, various electrical connectors 50 are included in the electrical system 46. These connectors 50 permit separation and reconnection of those components in the two portions A and B of the electrical system.

The electrical system 46 includes a base or primary power supply. This base power supply preferably comprises a battery 52. As illustrated in FIG. 3, the battery 52 may be conveniently mounted in the watercraft 20.

The electrical system 46 also includes a secondary power supply. This power supply comprises a charging coil 54 of the alternator associated with the engine 40. For example, the coil 54 may be associated with a flywheel mounted on the output or crankshaft of the engine 40, in place of the separate alternator, as is known to those of skill in the art. This coil 54 provides an electrical output when the engine 40 is running. The output passes through a rectification and voltage regulating circuit 56 including a rectifier and a regulator. Either the battery 52 or charging coil 54 provides power (12 volts) through an ignition power circuit 58 to the ignition control circuit 48.

As illustrated, power is provided through a watercraft power circuit 59 when the main switch 38 is closed. A main fuse 62 is provided along a circuit connecting the rectified charging coil 54 output and the battery 52 for preventing excessive current from flowing therethrough. Likewise, a similar fuse 64 is provided along the watercraft power circuit 59. During engine start-up, and before the charging coil 54 provides power, when the main switch 38 is closed, power is provided by the battery 52 through a back-up circuit 66. When the coil 54 is charging, power is provided therethrough to the ignition control circuit 48. The back-up circuit 66 may also provide power to the ignition control circuit 48 in the event the ignition power circuit 58 is damaged or a non-contact type switch 67, which is provided at the most upstream portion of the ignition control circuit 48, is jeopardized for some reasons.

As illustrated, power is provided to the various gauges and instruments associated with the control panel 34 through the watercraft power circuit 58.

The kill switch 39 is associated with a kill circuit 68. This circuit 68 connects to the ignition control circuit 48 and grounds the system (stopping the firing of the spark plugs 44*a–d* and thus stopping the engine 40) when closed.

Figure 5:
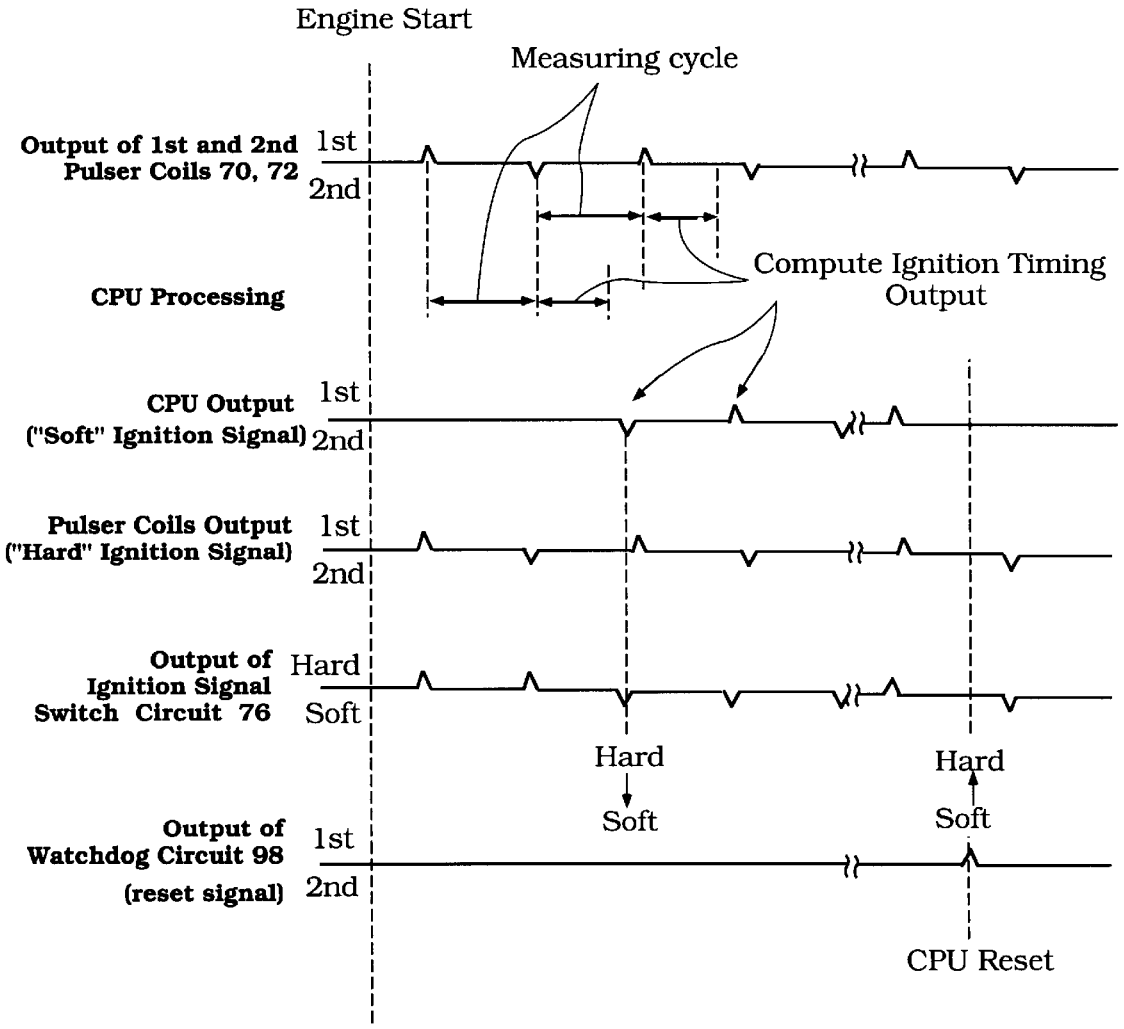
FIG. 5 is a graphical view showing the output of a CPU, switch circuit, watchdog circuit and pulser coils associated with the ignition control.

First and second pulser coils 70,72 are used to generate and output an ignition timing signal, as illustrated at the top of FIG. 5. In general, each pulser coil 70,72 provides an output signal or spike at a specific time, such as when a member mounted on a flywheel of the engine 40 passes by a pick-up element.

In this arrangement, the first pulser coil 70 provides an ignition timing signal corresponding to the spark plugs 44*a*,44*d* corresponding to the first and fourth cylinders, while the second pulser coil 72 provides such a signal corresponding to the spark plugs 44*b*,44*c* corresponding to the second and third cylinders. The output of the pulser coils 70,72 is provided to a central processing unit (CPU) 74 and an ignition signal switching circuit 76 of the ignition control circuit 48 through respective input circuits 78,80. The input circuits 78,80 are circuits through which analog signals are converted to digital signals. The ignition signal switching circuit 76 switches over direct ignition signals from the pulser coils 70,72 ("hard" ignition signals) to ignition signals made by the CPU 74 ("soft" ignition signals) and vise versa. More detail description in this regard will be given later. The output of the pulser coils 70, 72 are also provided to the non-contact type switch 67 to turn it on. Power is, then, provided to the CPU 74 through the non-contact type switch 67 and a constant voltage circuit 84. The constant voltage circuit 84 converts the DC voltage from the rectification and voltage regulating circuit 56 to the constant voltage that is about 5 volts.

A thermosensor 86 senses engine temperature. The thermosensor 86 is preferably a thermistor temperature sensor (NTC) that can sense changes in temperature. Other analog type temperature sensors such as a thermocouple are applicable as the thermosensor. The thermosensor 86 is positioned at an inlet portion of a coolant jacket and arranged to monitor the engine temperature by measuring the temperature of the coolant jacket associated with a cooling system of the engine 40. The output of the sensor 86 passes through an input circuit 88 to the CPU 74. The input circuit 88 is also an analog-digital converter. As described in more detail below, the CPU 74 utilizes the output of this sensor 86 in an engine overheat detection system.

An oil pressure switch 90 is also provided downstream of an oil pump (not shown) and will close in the event lubricant contained in the oil pan is shortage. When this switch 90 closes, a signal is sent to the CPU 74 through an input circuit 92. The input circuit 92 is also an analog-digital converter. At the same time, an alarm lamp 94, which is located in the hull 22 (area A), is activated. The alarm lamp 94 is allowed to be activated with very weak current. A load or resistance 96 is associated with the alarm lamp circuit to guarantee the operation of the alarm lamp 94. That is, the load 96 has a resistance value that can admit a current larger than the current that flows through the alarm lamp 94 to the oil pressure switch 90. Thus, even though the oil pressure switch 90 has a relatively high resistance due to oxidation or some other reasons, the operation of the alarm lamp 94 is guaranteed. The alarm lamp 94 is preferably mounted at or near the control panel 34 of the watercraft 20. Also, the alarm lamp 94 can be replaced by a sound alarm or a sound alarm can be added to the alarm lamp 94.

The ignition control circuit 48 includes a watchdog circuit 98. This circuit 98 monitors the condition of the CPU 74. As described in more detail below in conjunction with FIG. 5, the watchdog circuit 98 is arranged to reset the CPU 74 and the ignition signal switching circuit 76 with an appropriate output signal.

The ignition control circuit 48 also includes a capacitive discharge ignition (CDI) circuit 100. This circuit 100 includes a booster circuit (DC-DC converter) 102 which boosts up the 12 volts DC voltage up to about 300 volts DC Voltage. Through this booster circuit 102, a charging capacitor 104 is charged with ignition power from the battery 52 and the rectification and voltage regulating circuit 56. Thus, the charging capacitor 104 can be sufficiently charged even immediately after the engine 40 is started.

The spark plugs 44*a*,44*d* corresponding to the first and fourth cylinders are associated with a first ignition coil C1. The spark plugs 44*b*,44*c* corresponding to the second and third cylinders are associated with a second ignition coil C2. The first ignition coil C1 is linked through a first circuit to the charging capacitor 104, and the second ignition coil C2 is linked through a similar second circuit. The CDI circuit 100 includes a first thyristor 106 positioned along the first circuit, and a second thyristor 108 is positioned along the second circuit. Both thyristors 106,108 are controlled by an output signal from the ignition signal switching circuit 76.

When the switching circuit 76 sends an appropriate signal to either of the thyristors 106,108, they open and current is allowed to flow from the capacitor 104 through the first or second circuit to the first or second ignition coil C1,C2, at which time a spark is induced at the spark plugs corresponding thereto.

The ignition control circuit 48 has wiring that is proof at least against the maximum current coming from the rectification and voltage regulating circuit 56. Accordingly, no fuse is necessary at the ignition power circuit 58. In addition to that, the switch 67 is the non-contact type as noted above. Thus, the chance of breaking down of wiring to the ignition control circuit 48 is extremely rare. This is quite useful for the stable power supply to the ignition system.

Those of skill in the art will appreciate that in the four-cycle engine, each cycle comprises seven-hundred and twenty degrees of crankshaft rotation. In one three-hundred and sixty-degree rotation, each piston moves from top dead center downwardly to bottom dead center in an induction mode, then moves back to top dead center for combustion. In the next three-hundred and sixty degree cycle the piston moves downwardly as driven by the expanding combustion gasses, and then moves upwardly back to top dead center in an exhaust sequence.

In the engine arranged as described above, the piston corresponding to a pair of cylinders (such as the first and fourth cylinders) are generally in the same position, but three-hundred and sixty degrees apart in the operating cycle. In other words, when the piston corresponding to the first cylinder is at top dead center for combustion, the piston corresponding to the fourth cylinder is also at top dead center but in the exhaust sequence. Likewise, the second and third cylinders are so interrelated.

In the arrangement of the present invention, the spark plugs 44*a*,44*d* corresponding to the first and fourth cylinders are fired at the same time. As described in more detail below, the firing of the spark plug corresponding to cylinder which is in the combustion portion of the cycle is effective in initiating combustion, while the simultaneous firing of the spark plug corresponding to the other cylinder is ineffective since it is in exhaust mode. Thus, in each firing of both pairs of spark plugs 44*a*/44*d* and 44*b*/44*c* only one of the firings is "effective" or "actual" in the sense that it initiates combustion.

A first aspect of the ignition control will be described with reference to FIG. 5. Once the engine 40 is started, the pulser coils 70,72 provide first output signals, i.e., "hard" ignition timing signals, and the CPU 74 begins processing. In the preferred arrangement, the CPU 74 does not begin to provide an ignition timing output signal for some time after the engine 40 has been started. In the arrangement illustrated, this time constitutes two measuring cycles. These measuring cycles comprise a time between pulses or output spikes from the first and second pulser coils 70, 72. Thereafter, the CPU 74 provides a second or "soft" ignition timing signal which is based on, but may vary from, the first or "hard" ignition signal from the pulser coils 70,72. The CPU 74 may alter the first signal based on a variety of factors to optimize ignition firing timing.

During the time before the CPU 74 provides an ignition timing output signal ("soft" ignition timing signal), the spark plugs 44*a–d* are fired based on the output of the pulser coils 70,72 ("hard" ignition timing signal). In particular, the output of the pulser coils 70,72 is provided to the ignition signal switching circuit 76, which uses the signals directly as the ignition signals for the thyristors 106,108. After the CPU 74 begins providing an ignition firing signal, the ignition signal switching circuit 76 is arranged to move to a "soft" mode in which it utilizes the ignition timing signal from the CPU 74 as the ignition firing timing signal (i.e. the signals from the pulser coils 70,72 are used unless the CPU 74 is providing a signal). This arrangement is advantageous since it provides time for the CPU 74 to calculate an accurate firing timing signal considering actual engine conditions.

As also illustrated in this figure, in the event of engine shut-down or lack of power or the like, the watchdog circuit 98 is arranged to reset the CPU 74. Until the time for the CPU 74 to provide ignition timing signals has elapsed, the ignition signal switching circuit 76 is arranged to utilize the "hard" ignition timing signals from the pulser coils 70,72, as described above.

Figure 6:
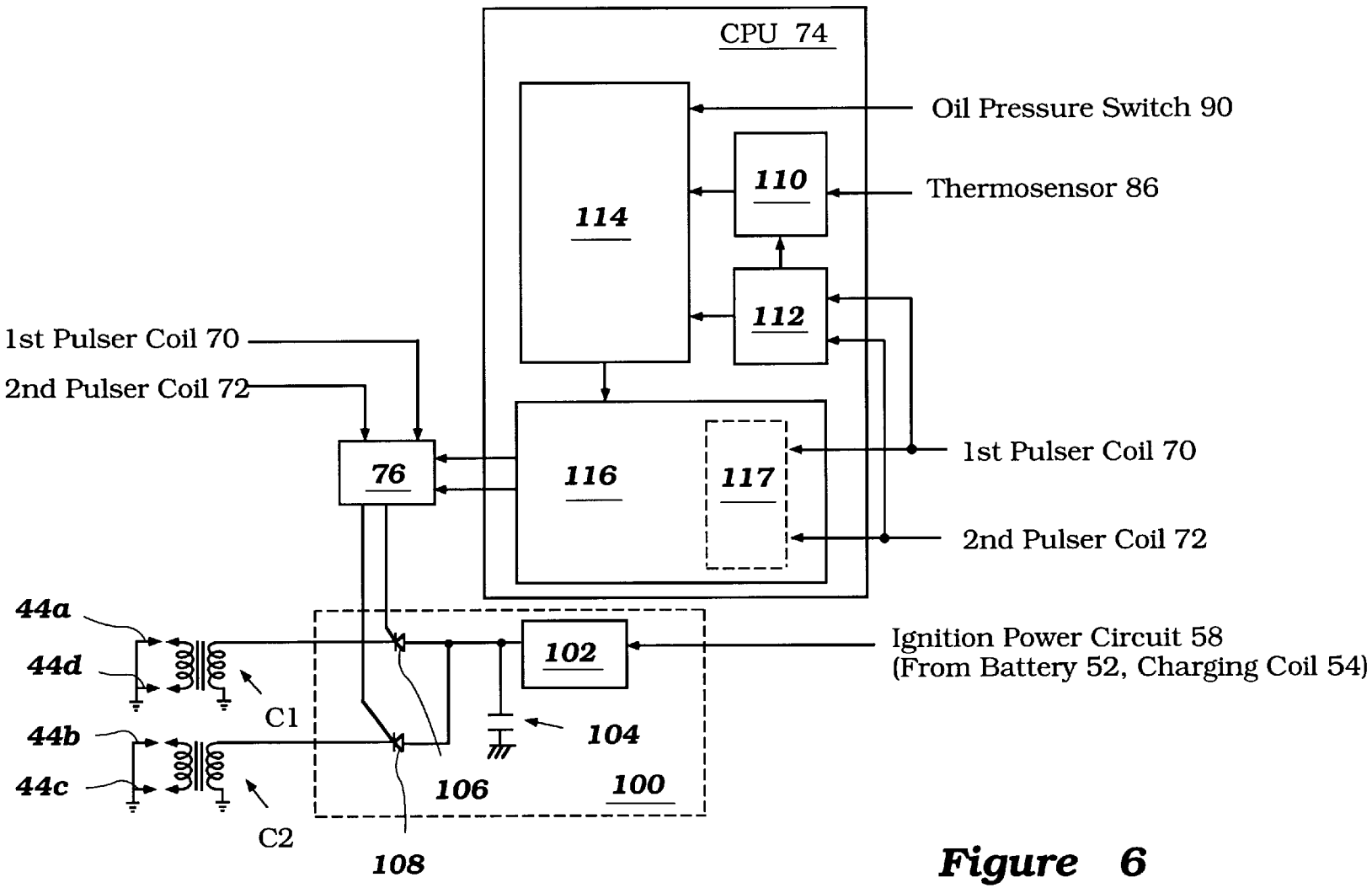
FIG. 6 is a block diagram showing a part of an ignition control circuit including the CPU, a CDI circuit and combination of spark plugs and ignition coils.

Additional aspects of the ignition control will be described with reference to FIG. 6. As illustrated, the CPU 74 preferably includes an overheat detection portion 110, an engine speed computation portion 112, a disabling cylinder determining portion 114, and an ignition signal output portion 116. The ignition signal output portion 116 has a control map to determine an optimum ignition timing under each engine operation condition based upon signals associated with the engine operation such as the engine speed signal and throttle valve opening signal. The ignition signal output portion 116 further determine which ignition coil should be fired and the output timing of each ignition signal that is adapted to the optimum ignition timing based upon the signals from pulser coils 70,72. The ignition signal output portion 116 includes an ignition order counter portion 117, which will be described more in detail with referring to FIG. 7 later.

It should be noted that the respective processing portions 110 to 117 are not distinct components and actually the CPU 74 has a memory (not shown) to memorize a sequential operational program that reflects functions of the respective portions 110 to 117.

The output of the thermosensor 86 is provided to the overheat detection portion 110. In the event an engine overheat situation is detected, an engine overheat protection function is employed by the CPU 74, as described in more detail below in conjunction with FIGS. 11 to 14.

The output of the pulser coils 70,72 is provided to the engine speed computation portion 112, which determines the engine speed from the output of the pulser coils 70,72. As described in more detail below, the CPU 74 employs an engine speed reduction or over-revolution prevention function in the event the engine speed exceeds a predetermined speed.

The output of the pulser coils 70,72 is also provided to the ignition order counter portion 117 of the CPU 74. This portion of the CPU 74 is arranged to utilize the pulser coil 70,72 signal output to count and assign a count value to these signals.

Figure 7:
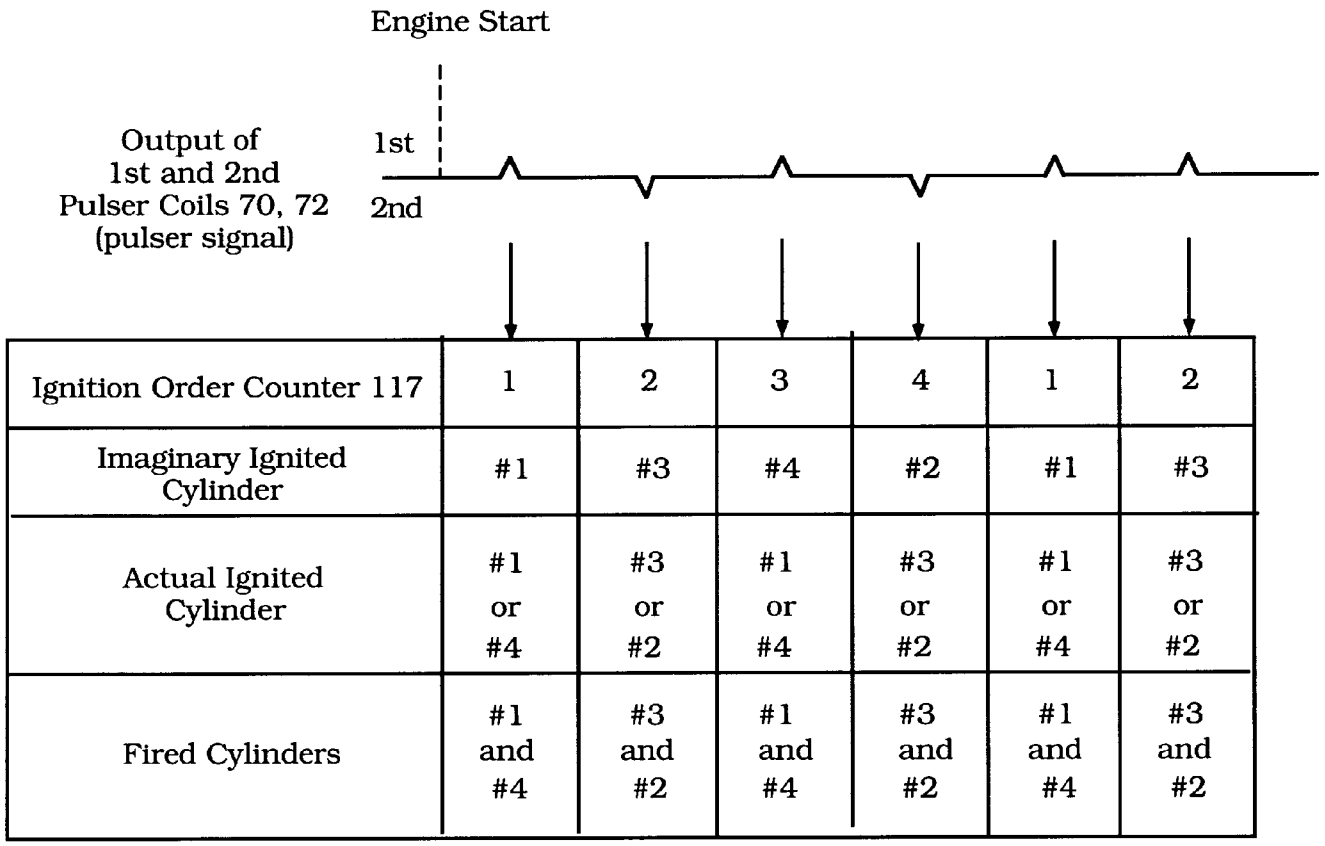
FIG. 7 is a table showing ignition order counter, imaginary ignited cylinder, actual ignited cylinder and fired cylinder data of the ignition control as compared to pulser coil output.

FIG. 7 is a table which correlates the pulser coil 70,72 outputs to a variety of cylinder firing data. When the first pulser coil 70 provides a first signal, the ignition order counter 117 gives the signal a value of 1. In the arrangement where the firing order for the cylinders is arranged to be 1, 3, 4, 2, the first signal is assumed to correspond to cylinder 1. In other words, an imaginary ignited cylinder value of 1 is assigned, since it is assumed the first cylinder fired. Since the first pulser coil 70 corresponds to the spark plugs 44*a*,44*d* corresponding to the first or fourth spark plugs, the fired cylinders associated with this signal number are 1 or 4. In actuality, because only one of those two cylinders is in the combustion portion of the cycle (the other being in the exhaust cycle) the cylinder in which ignition actually occurs is either cylinder 1 or cylinder 4.

The next signal received by the ignition order counter 117 is from the second pulser coil 72. When this signal is received, it is given a value of 2. The cylinder which is imagined to have fired is cylinder 3 (i.e. the second of the cylinders to fire in the firing order), and the actually fired cylinders must be 2 or 3, since the two spark plugs corresponding thereto fire together. Since only one of the cylinders is then in the combustion cycle, in either only cylinder 2 or 3 does ignition actually occur.

The next signal received by the ignition order counter 117 is from the first pulser coil 70. When this signal is received, it is given a value of 3. The imaginary cylinder firing corresponding to this value is 4, both cylinders 1 and 4 are actually fired, but combustion is only initiated in either cylinder 1 or 4.

The next signal received by the ignition order counter 117 is from the second pulser coil 70. When this signal is received, it is given a value of 4. The imaginary cylinder firing corresponding to this value is 2, the actually fired cylinders are 2 or 3, with combustion initiated in only cylinder 2 or 3. The data then repeats.

Figure 8:
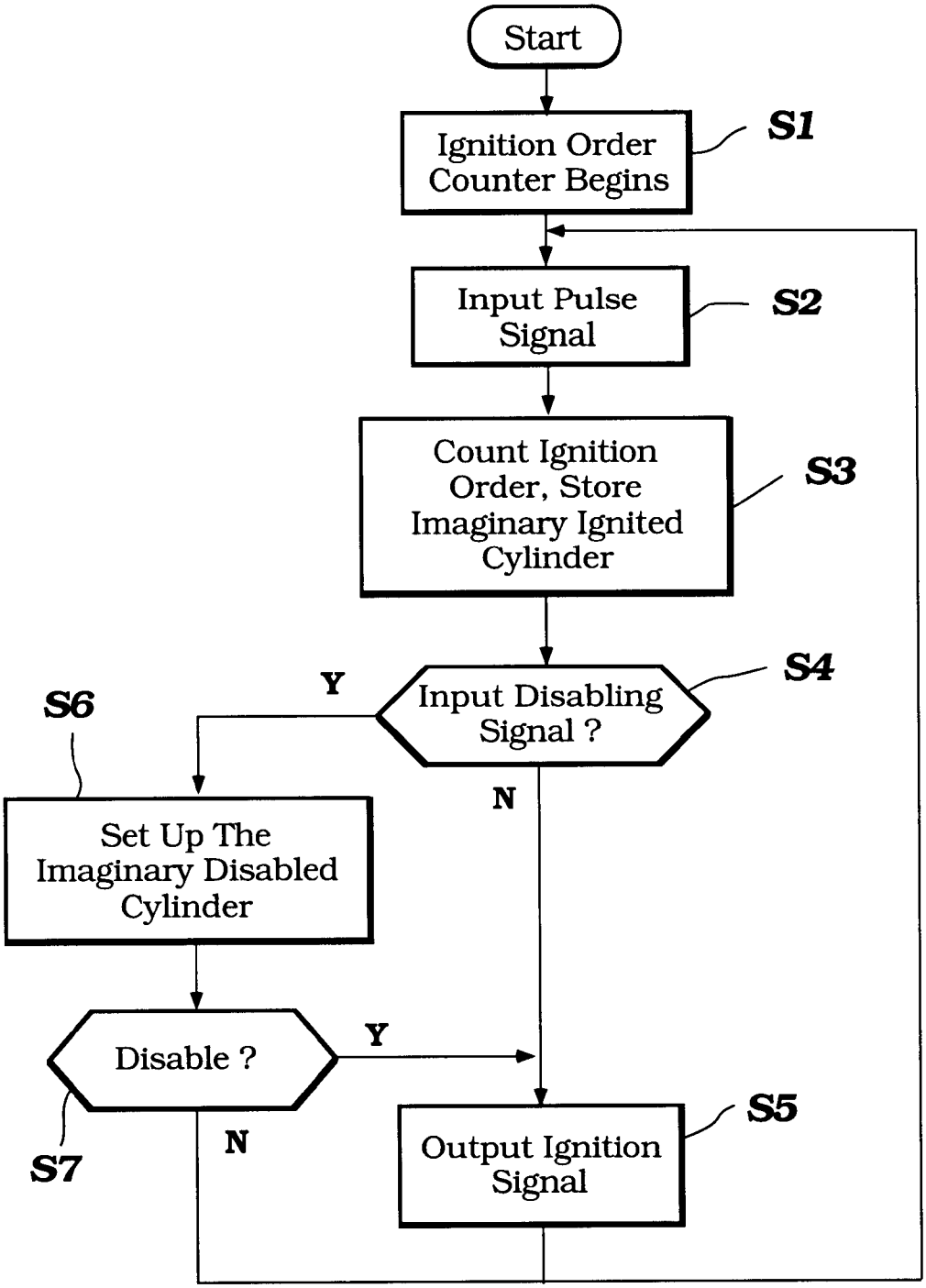
FIG. 8 is a flowchart showing a cylinder disabling function associated with the ignition system control.

FIG. 8 is a flowchart illustrating a cylinder disabling function of the CPU 74 as accomplished with the cylinder disabling portion 114 and ignition order counter 117. Once the engine 40 is started, and in a step S1, the ignition order counter 117 begins to function. In a step S2, an input signal is received from one of the pulser coils 70,72. In a step S3, the ignition order counter 117 assigns the signal an imaginary cylinder count number or value, as described above.

In a step S4, the CPU 74 determines if a disabling signal (as described below) has been received. If not, an ignition signal is output from the ignition signal output portion 116 of the CPU 74 to the switching circuit 76 in a step S5. If a disabling signal has been received, the cylinder disabling portion 114 of the CPU 74 is arranged to set up an imaginary disabled cylinder in a step S6. If in a step S7, if the imaginary disabled cylinder matches the imaginary ignited cylinder, then no ignition signal is provided and the process repeats. In that event, the lack of an ignition signal prevents the firing of a cylinder which is otherwise in the combustion portion of the operating cycle. If the imaginary disabled cylinder does not match the imaginary ignited cylinder, then an ignition signal is output in the step S5 and then the process repeats.

Figure 9:
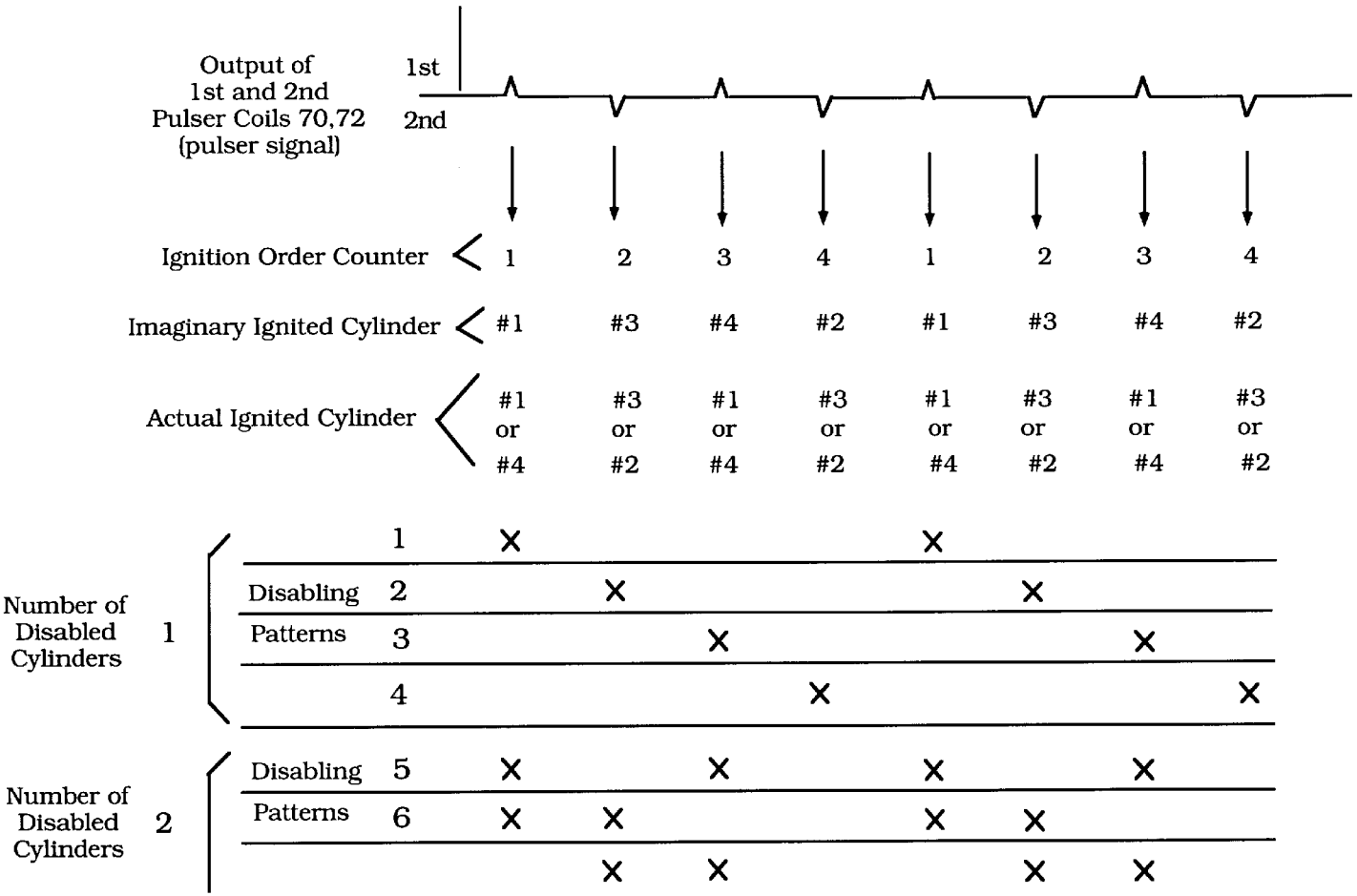
FIG. 9 is a table showing ignition order counter, imaginary ignited cylinder, actual ignited cylinder, fired cylinder data, and disabling cylinder patterns associated with the disabling function of the ignition control, as compared to pulser coil output.

FIG. 9 illustrates a cylinder disabling arrangement employed by the CPU 74. The disabling cylinder portion 114 of the CPU 74 is arranged to employ one or more disabling patterns for disabling one cylinder of the engine 40. In a first pattern, the imaginary disabled cylinder is given a value of one and each time the imaginary ignited cylinder value is one, no firing signal is sent by the CPU 74 to the ignition signal switching circuit 76, and the spark plugs 44*a*,44*d* corresponding to the first and fourth cylinders are not fired. This means that either the first or fourth cylinder, which would otherwise be set to fire, does not fire. On the other hand, when the imaginary ignited cylinder 4 is counted, a firing signal is provided, so that either the other of the first or fourth cylinders are actually fired each cycle. Of course, a firing signal is provided at both the imaginary ignited cylinder values of 2 and 3. In this manner, three of the four cylinders are fired each cycle.

As illustrated by patterns 2 to 4, a similar arrangement may be employed with imaginary disabled cylinder values of 2, 3 or 4, whereby three of the four cylinders are fired.

The cylinder disabling portion 114 is also arranged to disable two of the four cylinders. With reference to pattern number 5, the imaginary disabling cylinder values are set as both 1 and 4, whereby the CPU 74 does not send a firing signal when the imaginary ignited cylinder values are 1 and 4. In this arrangement, both the first and fourth cylinders are prevented from firing, while cylinders 2 and 3 are both fired.

As illustrated, the CPU 74 may be arranged to prevent the firing of any pair of two cylinders in similar fashion. It is generally desirable to fire the cylinders in evenly spaced patterns to promote smooth running of the engine.

Though not illustrated, the cylinder disabling portion 114 includes one or more patterns for disabling three of the four cylinders in similar fashion to that described above. In addition, the cylinder disabling portion 114 includes a pattern for disabling all cylinders in which no firing signal is provided at any time.

Figure 10:
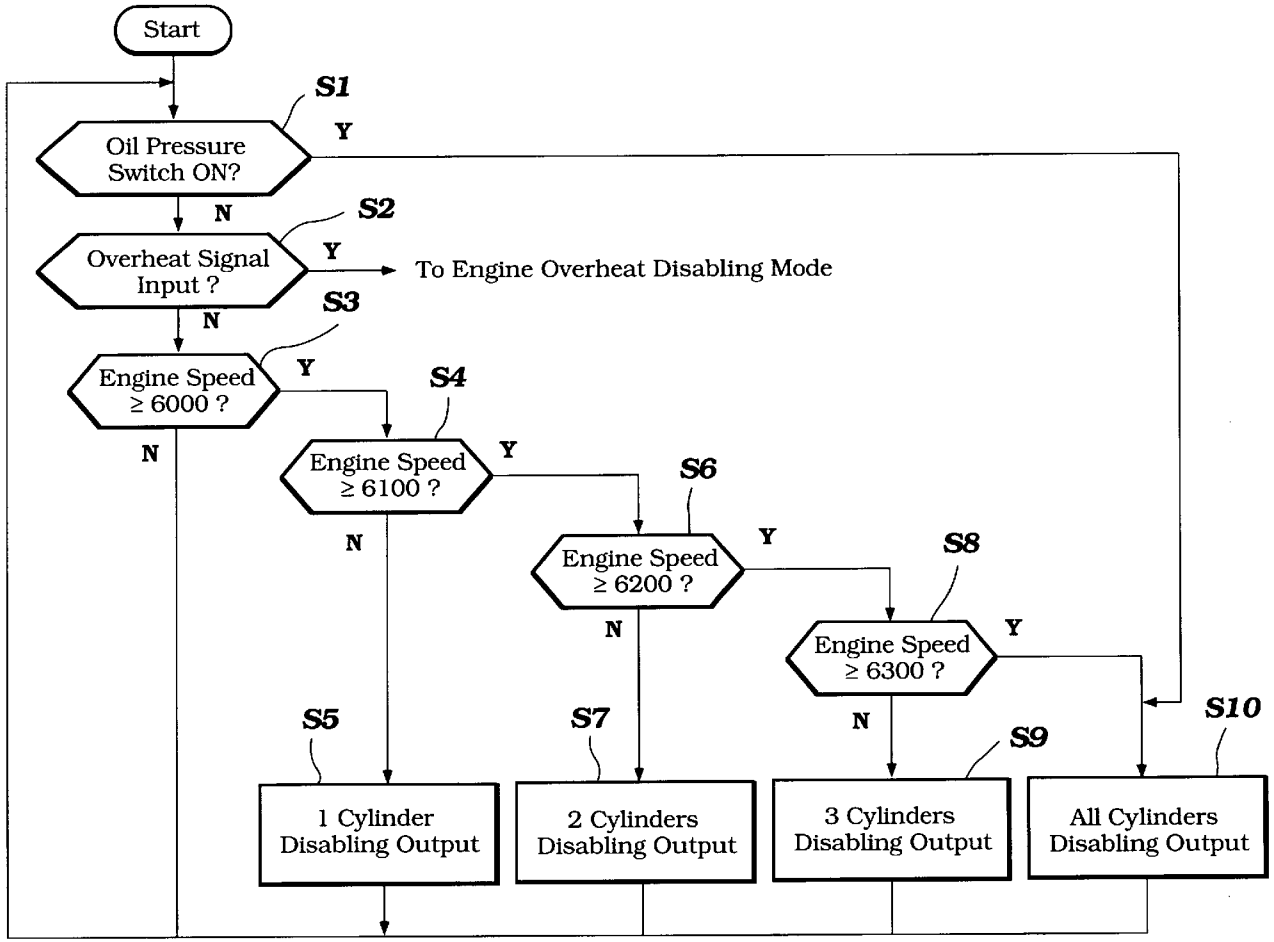
FIG. 10 is a flowchart showing an over-revolution or engine speed reduction function associated with the ignition control of the present invention.

FIG. 10 illustrates an engine speed disabling or over-revolution protection function of the ignition control. As illustrated, in a first step S1, the CPU 74 determines if the oil pressure switch is on. If so (indicating a lack of oil pressure), then the cylinder disabling portion 117 of the CPU 74 is arranged to disable all of the cylinders in a step S10. When all of the cylinders are prevented from running, the engine 40 stops and the user may check the lubricating system.

If the oil pressure switch is not on, in a step S2 the CPU 74 checks to determine if an engine overheat signal is received from the overheat detection portion 110. If so, an engine overheat disabling mode associated with an engine temperature control function, as described in more detail below, is instituted.

If not, in a step S3, the CPU 74 checks the engine speed as calculated by the engine speed computation portion 112. If the engine speed is less than a predetermined high engine speed, such as 6000 rpm, then in a step S3 then the process repeats itself.

If the engine speed is equal to or greater than this high speed, then in another step S4, the CPU 74 checks to see if the engine speed has become equal to or higher than a higher speed, such as 6100 rpm. If not (i.e. the engine speed is between 6000 and 6100 rpm), then in a step S5, the CPU 74 is arranged to disable one cylinder and the process repeats. This instruction is preferably input into the disabling function illustrated in FIG. 6 at step S4, wherein the cylinder disabling portion 114 employs one of the "one cylinder disabled" patterns described in conjunction with FIG. 9 to prevent the appropriate firing signal for disabling one cylinder.

If the engine speed is equal to or greater than this higher speed, then in a step S6, the CPU 74 checks to see if the engine speed has risen to or is above a higher speed, such as 6200 rpm. If not, in a step S7, the CPU 74 disables two cylinders. If so, then in a step S8, the CPU 74 checks to determine if the engine speed is at or above a still higher speed, such as 6300 rpm. If not, then the CPU 74 disables three cylinders in a step S9, and if so, then all cylinders are disabled in the step S10 and the engine is completely shut down.

FIGS. 11 to 14 illustrate various aspects of an engine overheat detection system.

Figure 11:
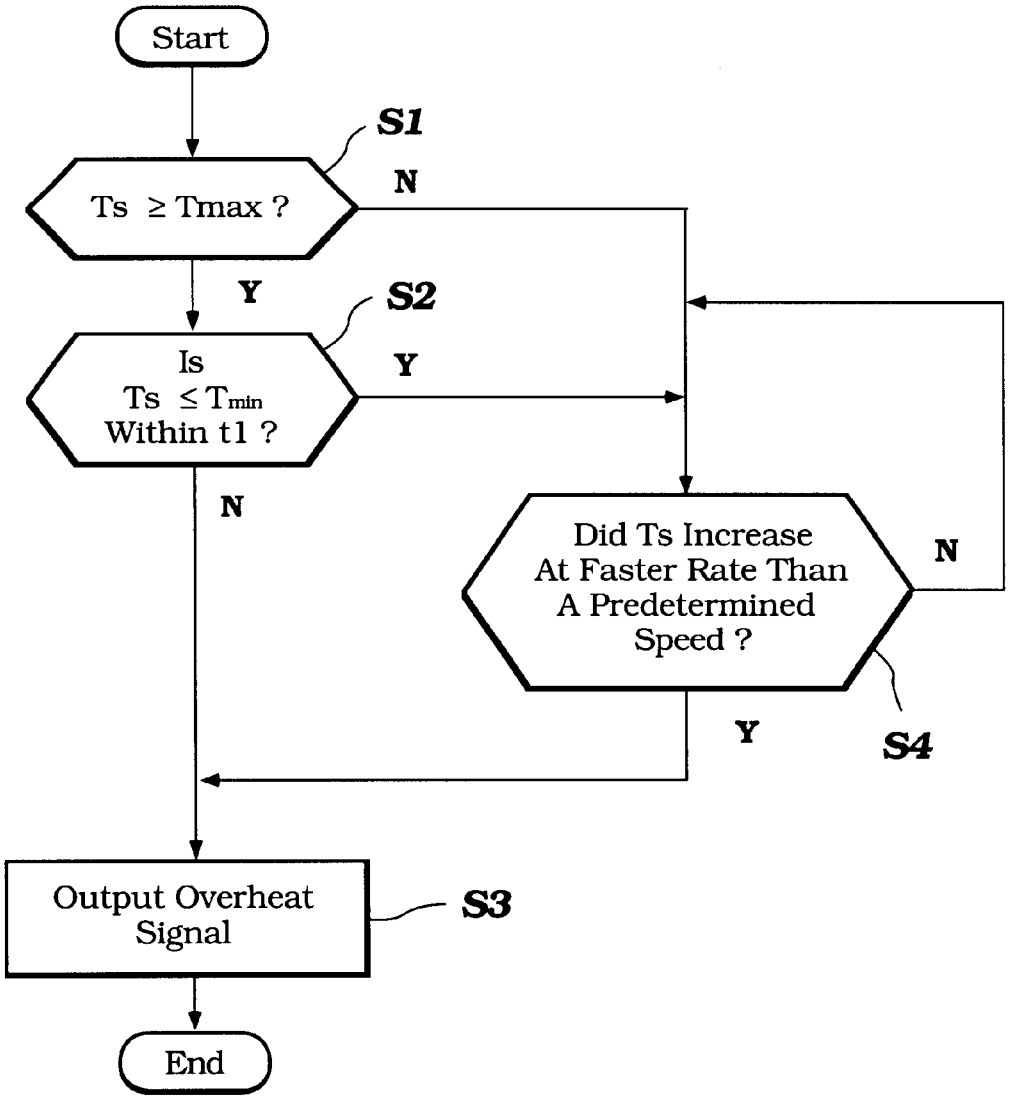
FIG. 11 is a flowchart showing a control routine of an overheat detection system. This system is associated with the ignition control.

This system includes the thermosensor 86 and the overheat detection portion 110 of the ignition control, as described above. As illustrated in FIG. 11, after the engine 40 is started, the CPU 74 is arranged to determine if an engine temperature Ts is equal to or greater than a predetermined high temperature Tmax in a step S1. This temperature Ts is received from the thermosensor 86. If so, then in a step S2, the CPU 74 checks to determine if the engine temperature Ts has fallen to a level equal to or below a predetermined low temperature Tmin within a predetermined time t1. If the temperature Ts has not fallen below Tmin, then in a step S3, an engine overheat signal is output.

If the temperature Ts is less than Tmax in step S1, then in a step S4, it is determined whether the temperature Ts is increasing at a faster rate of speed than a predetermined rate of speed. If so, then the overheat signal is output in the step S3. If not, then the CPU 74 repeats the step S4 to recheck the rate of increase in the temperature Ts until the engine is stopped.

If the temperature Ts is greater than Tmin in the step S2, then the rate of increase in the temperature Ts is checked in step S4, as described above.

Figure 12:
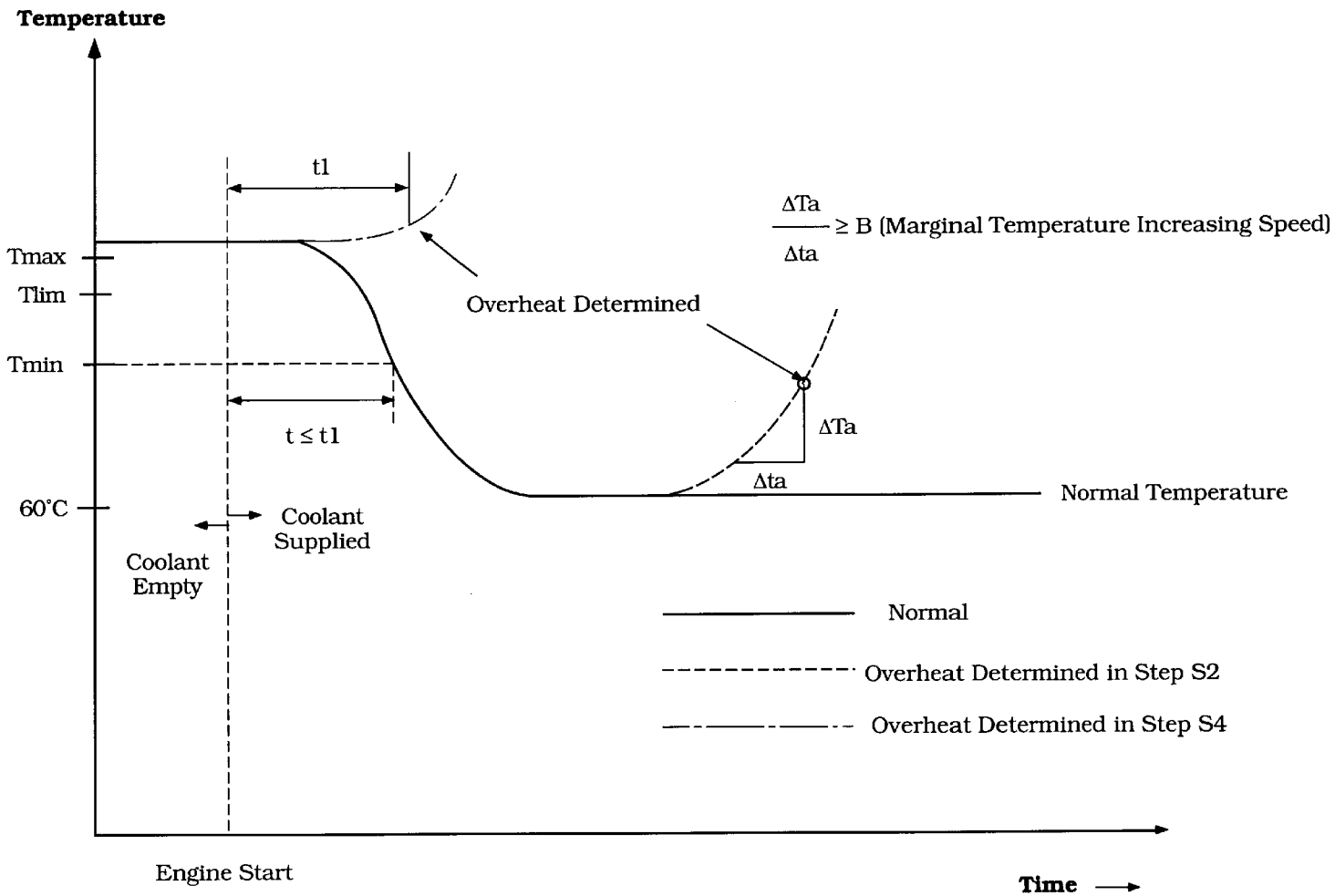
FIG. 12 is a graphical showing temperature versus engine running time and illustrating certain aspects of the overheat detection system.

FIG. 12 is a graph illustrating aspects of this overheat detection system. As illustrated and general with marine engines, the engine 40 is of the type having a coolant system in which when the engine is not running, there is no coolant in the water jackets. Coolant fills the water jackets and other passages some time after the engine 40 is started. Preferably, the time t1 is selected so that it is a long enough to permit coolant to enter and cool the coolant jacket.

In this graph, the line for the step S2 illustrates the condition when the temperature exceeds Tmax after a time t1 and an overheat condition is determined. Likewise, if the rate of increase in temperature as evident by the line step S4 exceeds a predetermined rate of increase (marginal temperature increasing speed) $\beta=\Delta Ta/\Delta ta$, then an overheat condition is determined. The CPU 74 has an own clock or time counter therein and hence the predetermined rate of increase is calculated.

Figure 13:
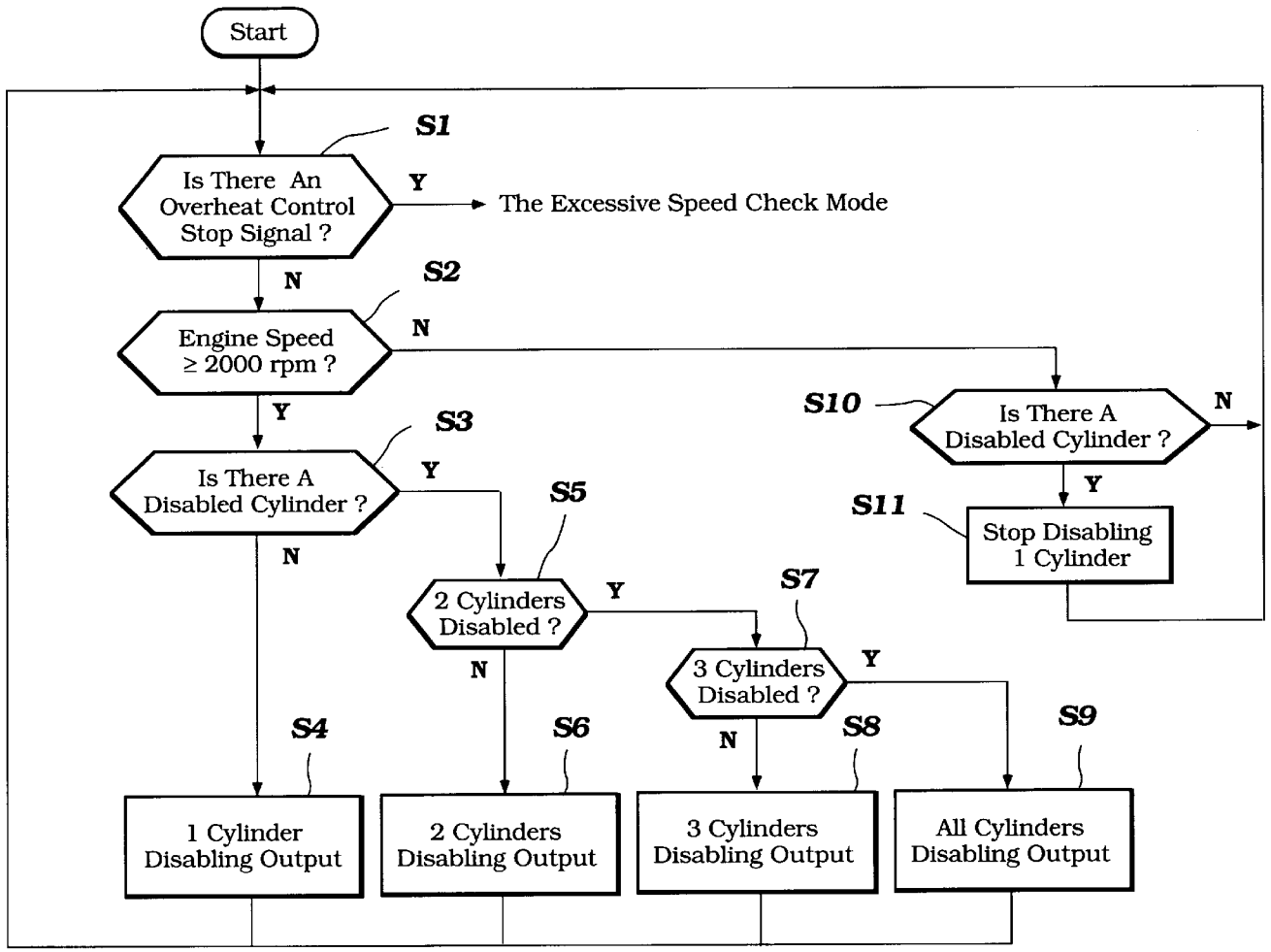
FIG. 13 is a flowchart showing a cylinder disabling prevention function associated with the overheat detection system of the present invention.

FIG. 13 is a flowchart illustrating an engine temperature reduction function of the ignition control associated with the overheat detection system. After the engine starts, in a step S1, it is determined if there is an engine overheat detection signal. If not, then the CPU 74 is arranged to check for excessive engine speed (see flowchart illustrated in FIG. 10 and described above). If an engine overheat detection signal is received, then in a step S2, it is determined if the engine speed is equal to or greater than a predetermined low speed, such as 2000 rpm. If not (i.e. the engine speed is less than 2000 rpm) then in a step S10, it is determined if there are any disabled cylinders. If not, the process returns to the step S1, and if so, then these cylinders are not disabled to bring up the engine speed, and the process returns to the step S1.

If the engine speed is equal to or greater than 2000 rpm, then in a step S3 it is determined if there are any cylinders disabled. If not, then in a step S4, an instruction to disable one cylinder of the engine is output (such as in the step S4 of the flowchart illustrated in FIG. 8 and associated with the patterns illustrated in FIG. 9). The process then returns to the first step S1.

If there is already one disabled cylinder, then in the step S5, it is determined if there are two cylinders disabled already. If not, then in the step S6 an instruction to disable two cylinders is output and the process returns to the step S1.

If so, then in a step S7 it is determined if there are three cylinders disabled. If not, then in a step S8 an instruction to disable three cylinders is output and the process returns to step S1. If so, then in a step S9 an instruction to disable all cylinders is output.

Figure 1:
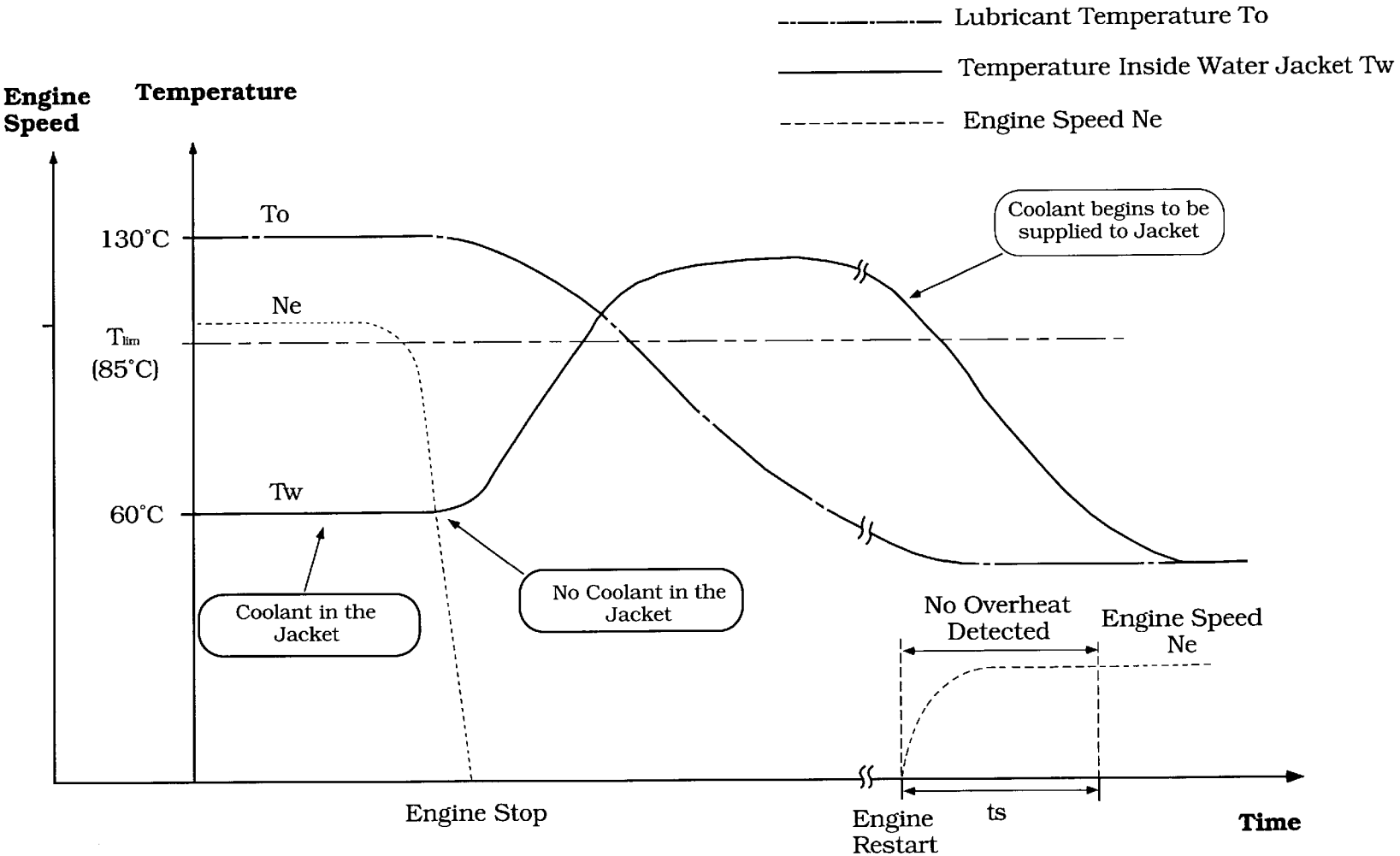
FIGS. 1 and 2 are already laid for the reader's better understanding of the background of this invention. However, these figures should not be recognized as showing a prior art and thus the related art shown in the figures will be again described hereunder more in detail.
Figure 2:
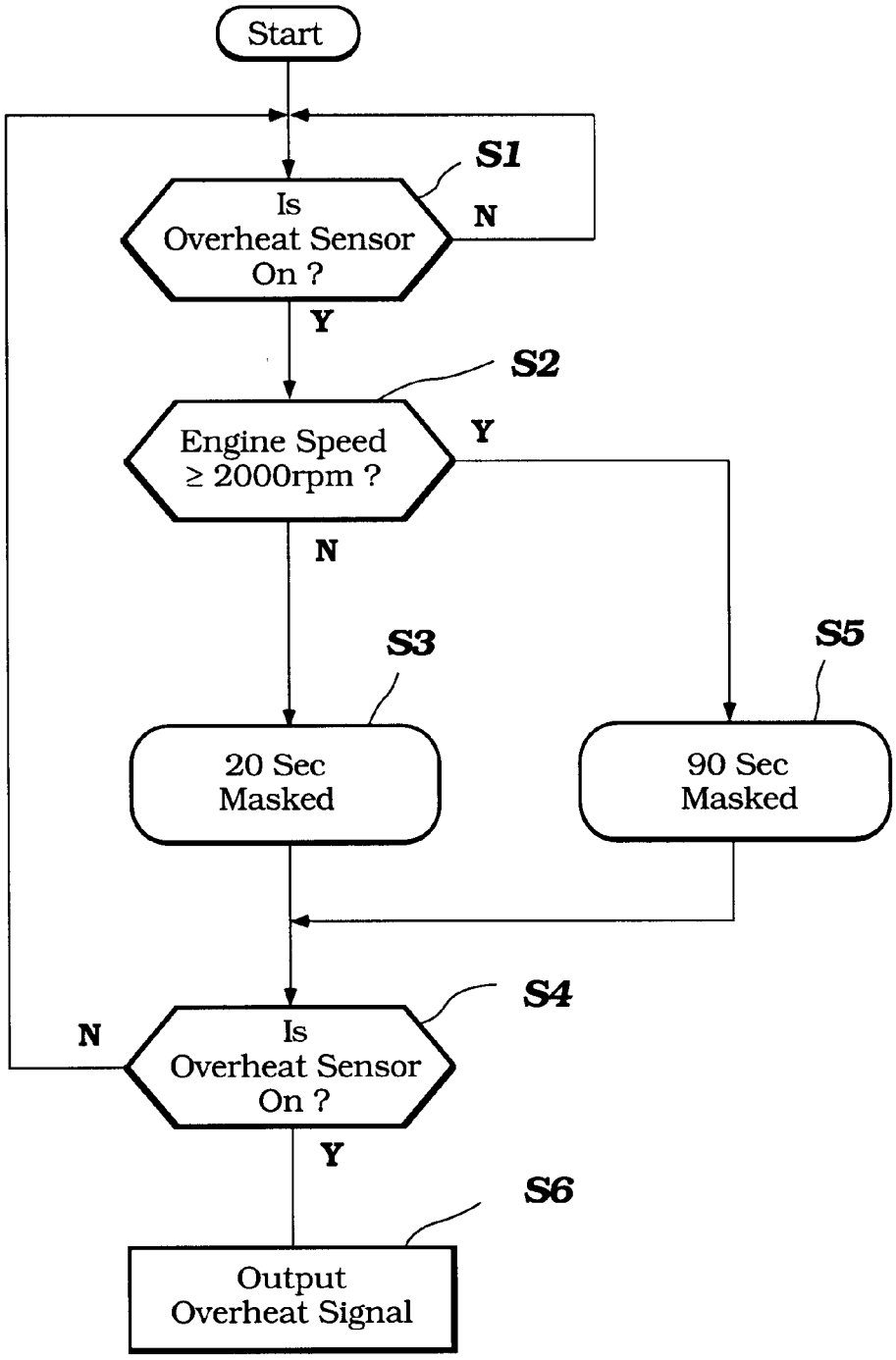

Referring to FIG. 1 again, it may now be seen how the overheat detection system overcomes some problems associated with those systems of the prior art. Referring to the lower right-hand portion of this graph, when the engine is re-started when the temperature in the cooling jacket exceeds the temperature Tlim, an overheat detection signal is not generated, since the temperature Tw in the jacket falls below Tlim due to the entry of coolant into the jacket during the predetermined time ts or t1. Of course, should coolant not enter the jacket or a similar problem be encountered, the temperature Tw would still exceed Tlim after time ts, and an overheat detection signal would be generated. As described above, the overheat detection system includes means for preventing the transmission of an overheat signal during the predetermined time t1. In the arrangement illustrated in FIG. 11, this means is arranged to make a comparison of the sensed temperature to the predetermined temperature Ts only after the passage of this time.

The system could be arranged so that no signal is received for the time t1 or the comparison is made but no signal may be output during time t1.

As described above, however, another problem arises if the prevention time t1 is relatively long. That is, in the event an actual overheat happens, no overheat signal is provided during this time and the engine must operate under this overheat condition for a while. Of course, if the temperature is increasing at a faster rate of speed than a predetermined late, then the overheat can be detected. If not, however, the overheat signal will not be provided and the engine must still operate under the overheat condition.

In order to improve the inconvenience and ensure the accurate overheat detection, an overheat detection system (including a variation) shown in FIGS. 14 to 17 is useful. The overheat detection system will now be described below with reference to these figures.

Figure 14:
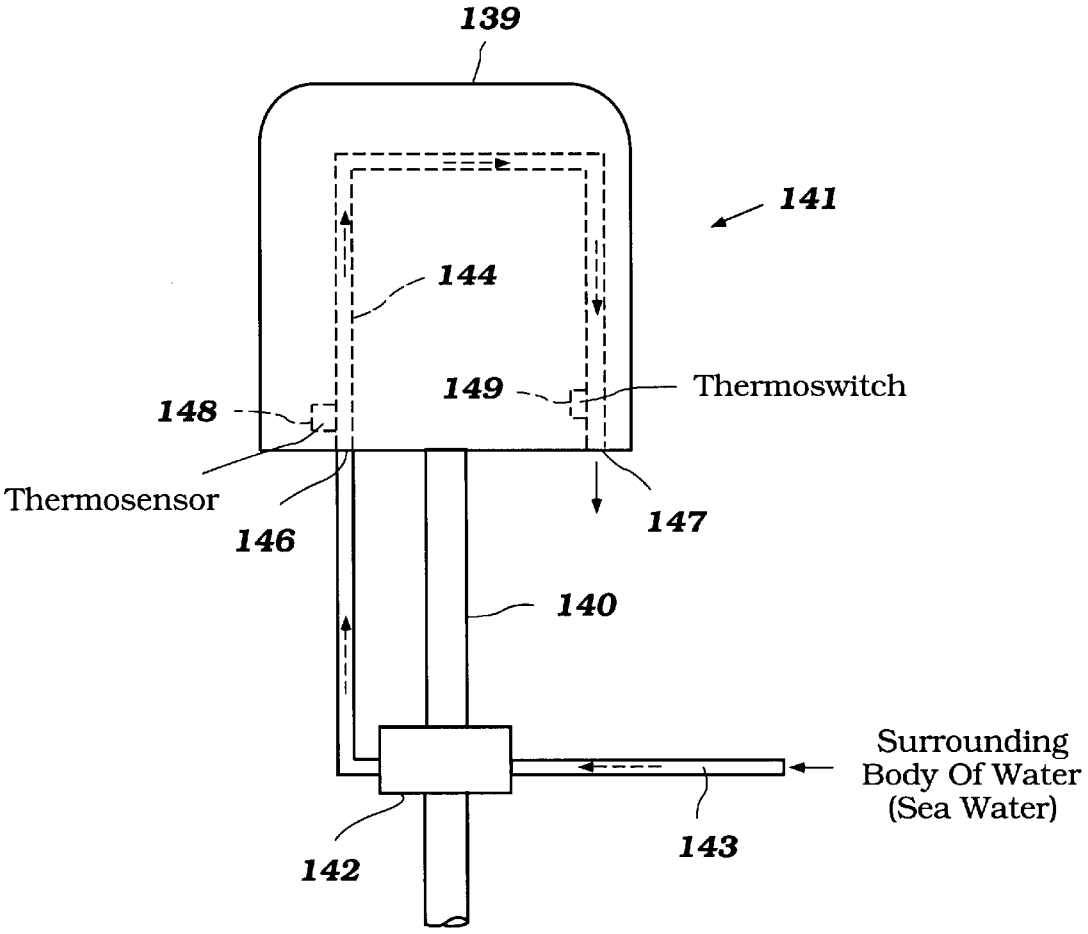
FIG 14 is a schematic view partially showing an outboard motor including an engine and particularly a cooling system. The cooling system embodies this invention therein.

FIG. 14 illustrates a schematic view partially showing an outboard motor including an engine and particularly a cooling system.

An engine 139 has a driveshaft 140 extending thereunder through an outboard motor 141 to drive a propeller (not shown). At its middle portion, a cooling water pump 142 is provided to be driven by the driveshaft 140. A water intake conduit 143 extends through the water pump 142 from the engine 139 to a portion of the motor 141 where submerged when the engine 139 is running. The engine 139 has a coolant jacket 144 which is connected to the water intake conduit 143 at an inlet portion 146. Cooling water is induced into the coolant jacket 144 through the water intake conduit 143 by means of the cooling water pump 142 from the surrounding body of water so as to cool down at least one portion of the engine 139 where heated during engine operation. The cooling water flows through the water intake conduit 143 and the coolant jacket 144 as shown by the arrows and then the water is discharged from an outlet portion 147 of the coolant jacket 144 to the body of water.

At the inlet portion 146 of the coolant jacket 144, a thermosensor 148 is provided. The thermosensor 148 is the same as the thermosensor 86 aforenoted and can be formed with a thermistor temperature sensor. In the meantime, at the outlet portion thereof, a thermoswitch 149 is also provided. The thermoswitch 149 is a sensor of the bimetal type and has two states, i.e., on and off.

Since the conventional thermal sensor 148 is disposed well upstream of the point of discharge of the cooling water from the outlet portion 147, it may not always give an accurate indication of an overheat condition. That is, if the flow of cooling water is restricted, for example, because of seaweed or contaminants, then the water flow through the cooling jacket 144 will be restricted. However, since the thermosensor 148 is in a more upstream position than the thermoswitch 149, it may not sense the actual temperature of the engine since the cooling water is relatively at a low temperature when it is drawn from the surrounding body of water. However, as the water passes through the cooling jacket 144 because of the inadequate flow, its temperature will rise significantly. Thus, by placing the thermoswitch 149 close to the outlet 147, it will be ensured that this rise in engine temperature will be detected.

Rather than using an expensive thermosensor at this location, however, a less expensive and, in this instance, more reliable, thermoswitch can be utilized.

The inlet portion 146 and the outlet portion 147 should not be understood in the narrow sense. They include certain area.

Also, the portion where the thermoswitch 149 is positioned is in the relatively proximity to the combustion chambers of the engine 139 in the outboard motor 141. Accordingly, the temperature at which the thermoswitch 149 is turned on is preferably selected to be higher than the temperature Tmax for the thermosensor 148. However, both of the temperatures can be the same as each other.

Figure 15:
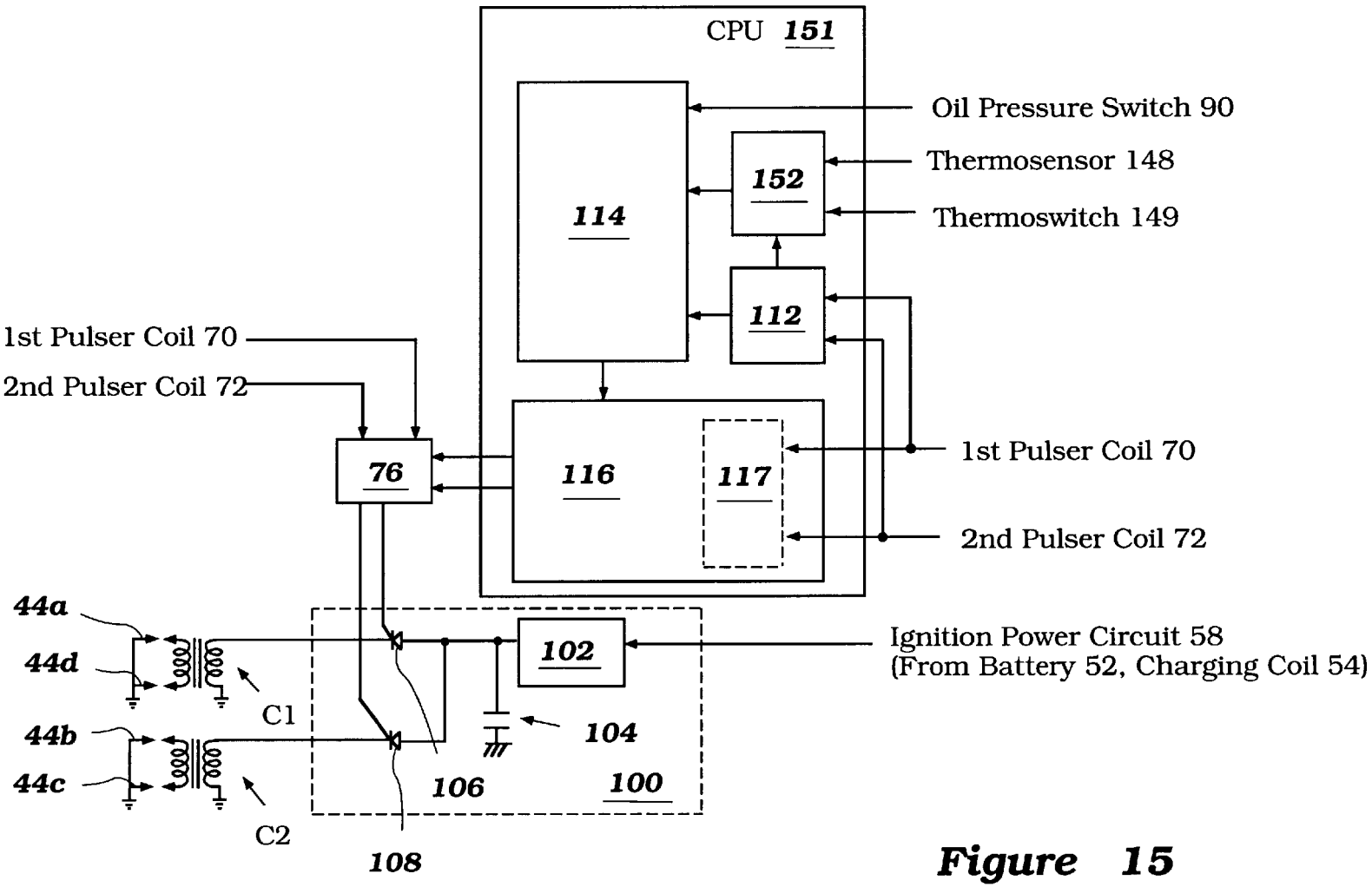
FIG. 15 is a block diagram showing a part of an ignition control circuit including a CPU, CDI circuit and combination of spark plugs and ignition coils.

FIG. 15 illustrates a block diagram showing a part of an improved ignition control circuit including a CPU 151, the CDI circuit and combination of spark plugs and ignition coils. The same portions, components or elements as described with reference to FIGS. 1 to 13 are assigned with the same reference numerals and further descriptions on them will be omitted so as to avoid redundancy.

The CPU 151 has an overheat detection portion 152 that receives outputs from the thermosensor 148 and the thermoswitch 149 to determine whether an overheat occurs or not.

Figure 16:
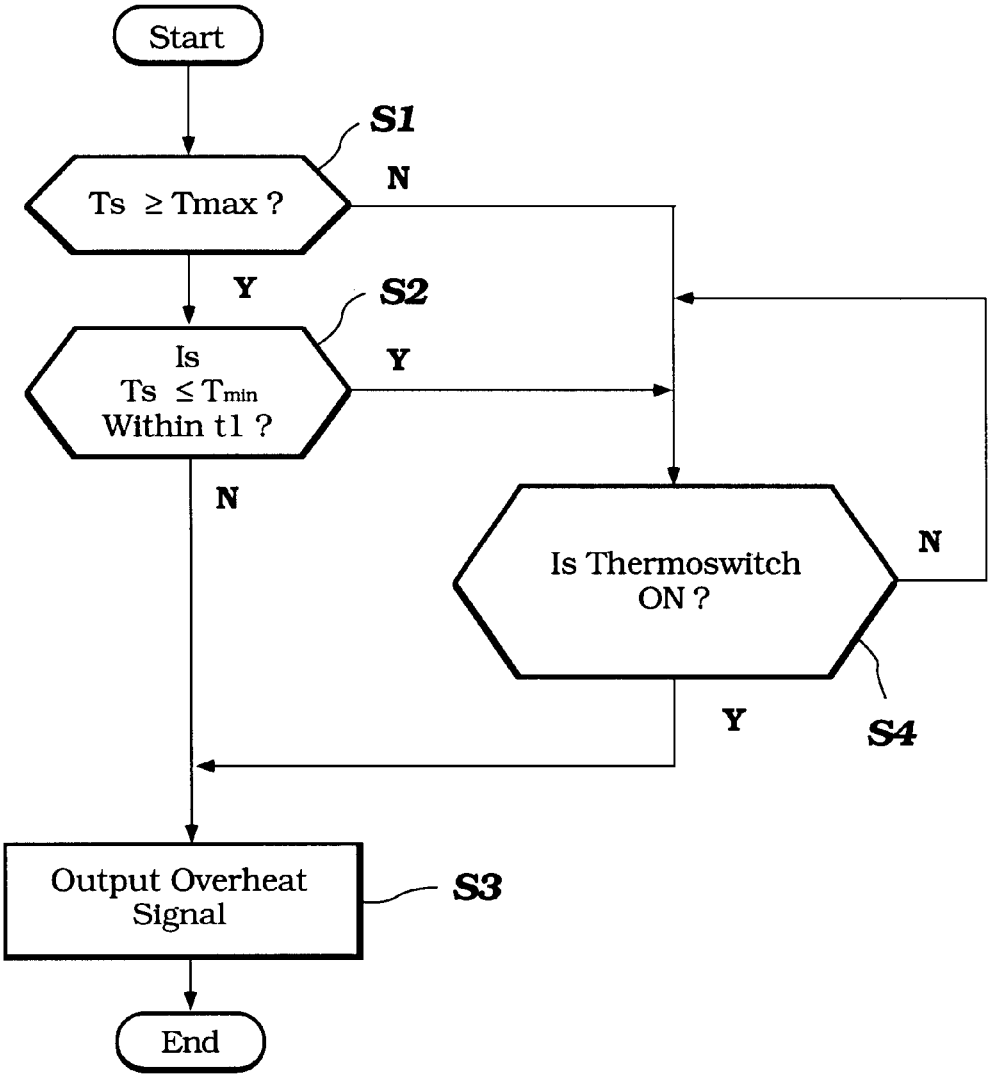
FIG. 16 is a flowchart showing a control routine of an overheat detection system embodying this invention. This system is associated with the ignition control.

One example of a flowchart for determination of an overheat is shown in FIG. 16. The flowchart is almost similar to the flowchart shown in FIG. 11 except for a step S4.

After the engine 40 is started, the CPU 151 is arranged to determine if an engine temperature Ts is equal to or greater than a predetermined high temperature Tmax in a step S1. This temperature Ts is received from the thermosensor 148. If so, then in a step S2, the CPU 151 checks to determine if the engine temperature Ts has fallen to a level equal to or below a predetermined low temperature Tmin within a predetermined time t1. If the temperature Ts has not fallen below Tmin, then in a step S3, an engine overheat signal is output.

If the temperature Ts is less than Tmax in the step S1, then in a step S4, it is determined whether the thermoswitch 149 is turned on or not. If the thermoswitch 149 is turned on, then in the step S3, an engine overheat signal is output also. Because, as described above, induced cooling water extremely decreases in this situation and hence the engine portions are not sufficiently cooled. If the thermoswitch 149 is not turned on, the program goes back to the step S1 to repeat the routine again.

When an engine overheat signal is output, the aforenoted ignition control system will disable one or more combustion chambers in accordance with the logic as described above.

As described above, the thermoswitch 149 is provided downstream of the thermosensor 148 and preferably at the outlet portion 147 of the coolant jacket 144 in this embodiment. Thus, the overheat detection portion 152 of the CPU 151 will not make any erroneous determination at any time even during the time t1. The overheat detection, hence, can be more reliable.

On the other hand, the two sensor arrangement also allow one sensor (the thermosensor 147 in this embodiment) to be located at a portion where affixing is easy but where the temperature of coolant is lower. This portion is the fore portion of the coolant jacket 144 and, more specifically, the inlet portion 146.

Figure 17:
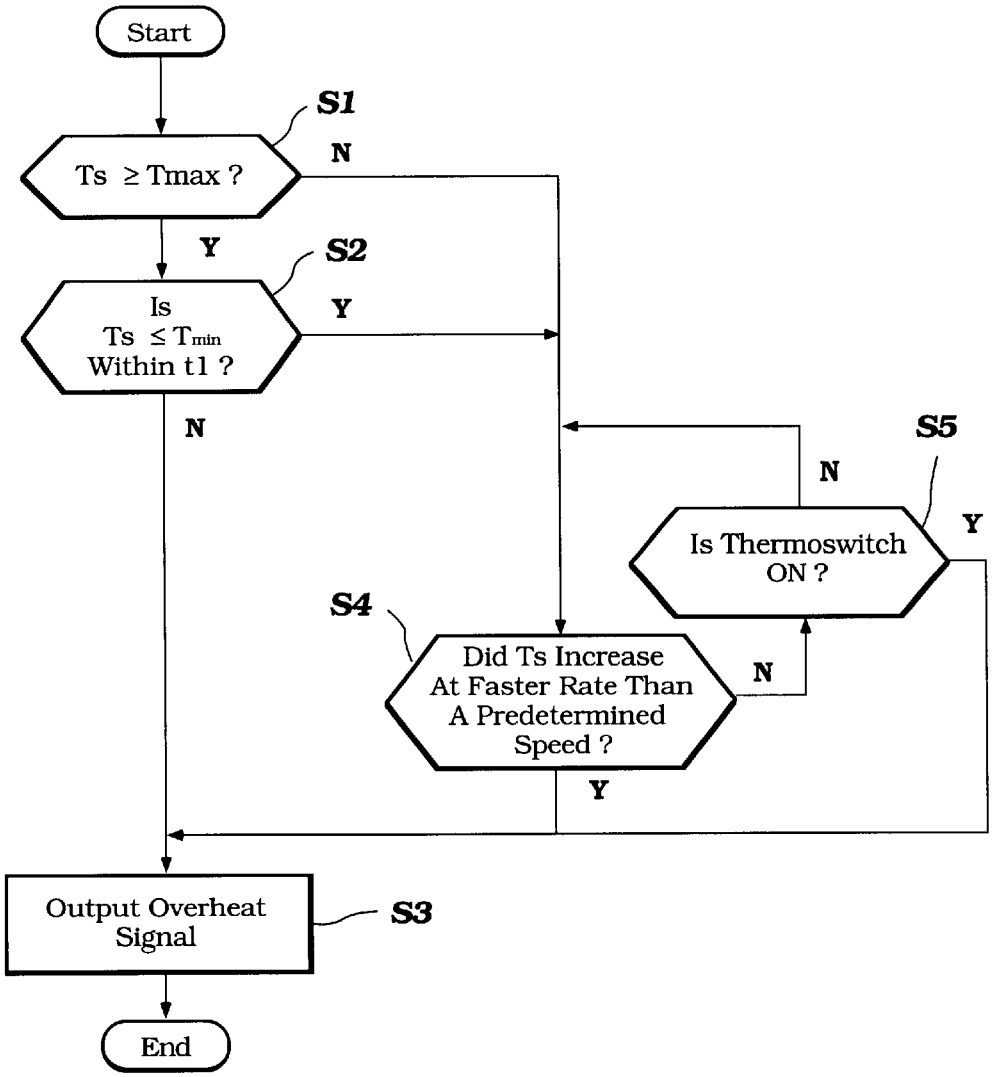
FIG. 17 is another flowchart showing a control routine of an overheat detection system embodying this invention in another way. This system is associated with the ignition control also.

Another flowchart for the overheat detection system wherein the two sensors 148, 149 are provided is illustrated in FIG. 17. In this flowchart, a step S5 is added to the flowchart shown in FIG. 11. Since the other flows are the same as described with reference to FIG. 11, only the step S5 will be described hereunder.

If, in the step S4, the temperature Ts is not increasing at a faster rate of speed than a predetermined rate of speed, the program goes to the step S5 and determine if the thermoswitch 149 is turned on or not. If this is positive, then in the step S3, an engine overheat signal is output. If it is negative, the program repeats the check in the step S4 until the engine is stopped.

When an engine overheat signal is output, the ignition control system will again disable one or more combustion chambers as described above.

According to this embodiment, in addition to the advantages described above, an overheat condition can be detected without delay even when the abnormal condition occurs below the temperature Tmin.

It should be noted that three or more sensors can be applied. If so, the other sensors are disposed uniformly between the thermosensor and the thermoswitch. Otherwise, it is an idea to locate larger numbers of them at the aft part than the fore part of the coolant jacket 144. Further, selection of the thermosensor or the thermoswitch depends on conditions and various arrangements can be applied.

It should be also noted that the engine to which the overheat detection system of this invention is practiced is not limited to the aforedescribed engines that have a simultaneous firing type ignition system but other various engines.

It should be further noted that the controlled engine speed under the condition of overheat is not limited to 2000 rpm and the slow down speed depends on individual engines. Moreover, other engine controls can be applied other than the slowdown of engine speed.

It should be still further noted that the overheat detection signal can be used for an overheat alarm indicator and/or an overheat sound alarm in addition to the engine disable control or in replace of the same.

The embodiments thus far described are all in connection with an outboard motor. However, the invention also can be utilized with various engines such as another marine engine, land vehicle engine including a lawn mower engine and stationary engine.

Of course, the foregoing description is that of preferred embodiments of the invention, and various changes and modifications may be made without departing from the spirit and scope of the invention, as defined by the appended claims.

What is claimed is:

1. An outboard motor comprising a propulsion unit, an internal combustion engine arranged to power said propulsion unit, a water cooling system arranged to introduce cooling water into said engine from the body of water surrounding said propulsion unit and to discharge the cooling water to the body of water, said cooling system being further arranged to drain the cooling water outside of said outboard motor when said engine does not operate, said cooling system including at least one water passage extending through, at least in part, said engine, said water passage having an outlet port from which the cooling water is discharged, a sensor arranged to sense a temperature associated with said water passage to output a temperature signal when a sensed temperature exceeds a predetermined temperature, said sensor being positioned generally close to said outlet port, and a controller configured to determine an overheat condition of said engine based upon the temperature signal from said sensor.

2. An outboard motor as set forth in claim 1 wherein said sensor is positioned immediately upstream of said outlet port.

3. An outboard motor as set forth in claim 1 wherein said engine includes a plurality of combustion chambers, an air intake system for admitting air to said combustion chambers, a fuel supply system for supplying fuel to said combustion chambers, an ignition system for firing air/fuel mixtures in said combustion chambers, said ignition system including spark plugs each disposed at each one of said combustion chambers, and an ignition control system arranged to disable at least one of, but not all of, said spark plugs when said controller determines the overheat condition of said engine.

4. An internal combustion engine comprising a cooling system, said cooling system including at least one coolant jacket into which coolant is supplied for cooling at least a portion of said engine, said coolant jacket having an inlet portion through which the coolant is introduced and an outlet portion from which the coolant is discharged when said engine is running, said cooling system arranged to drain the coolant from said coolant jacket when said engine is not running, a first sensor arranged to sense a temperature associated with said coolant jacket and to output a first temperature signal, said first sensor being disposed at an aft part of said coolant jacket including said outlet portion, a second sensor for sensing a temperature associated with said cooling jacket to output a second temperature signal, said second sensor being disposed upstream of said first sensor in said coolant jacket, and means for determining an overheat condition of said engine based upon at least one of the first and second temperature signals.

5. An internal combustion engine as set forth in claim 4 wherein said second sensor is positioned at a fore part of said coolant jacket including said inlet portion.

6. An internal combustion engine as set forth in claim 5 wherein said second sensor is positioned generally at said inlet portion of said coolant jacket.

7. An internal combustion engine as set forth in claim 4 wherein said overheat determining means outputs an overheat signal, said engine further comprises means for preventing the overheat signal from being output for a predetermined time after said engine starts, based upon the second temperature signal.

8. An internal combustion engine as set forth in claim 4 wherein said overheat determining means outputs an overheat signal, said engine further comprises means for determining a rate of increase of the temperature sensed by said second sensor, and said overheat determining means is arranged to output the overheat signal if the rate of increase exceeds a predetermined rate of increase.

9. An internal combustion engine as set forth in claim 4 wherein said overheat determining means determines the overheat condition of said engine when either one of sensed temperatures by said first sensor or said second sensor exceeds each one of the predetermined first or second temperature.

10. An internal combustion engine as set forth in claim 4 wherein said first sensor includes a thermoswitch, and the first temperature signal is provided when said thermoswitch is turned on.

11. An outboard motor as set forth in claim 1 additionally comprising a second sensor arranged to sense a temperature associated with said water passage to output a second temperature signal when a sensed temperature exceeds a second predetermined temperature, said second sensor being positioned upstream of said first sensor, wherein said controller determines the overheat condition of said engine based upon at least one of the first and second temperature signals.

12. An outboard motor as set forth in claim 11 wherein said controller generates an overheat signal, said controller further being configured to prevent the overheat signal from being output for a predetermined time after said engine starts, based upon the second temperature signal.

13. An outboard motor as set forth in claim 11 wherein said controller is further configured to determine a rate of increase of the temperature sensed by said second sensor and to generate an overheat signal if the rate of increase exceeds a predetermined rate of increase.

14. An overheat detection system for an internal combustion engine having a cooling system including at least one coolant jacket into which coolant is supplied for cooling at least a portion of said engine, said coolant jacket having an inlet portion through which the coolant is introduced and an outlet portion from which the coolant is discharged when said engine is running, said cooling system arranged to drain the coolant from said coolant jacket when said engine is not running, said overheat detection system comprising at least two sensors for sensing temperatures associated with said coolant jacket to output temperature signals, one of said sensors being positioned at a fore part of said coolant jacket including said inlet portion, another one of said sensors being positioned downstream of said one sensor, and a controller configured to determine an overheat condition of said engine based upon temperature signals from said sensors when at least one of sensed temperatures exceeds a predetermined temperature.

15. An overheat detection system as set forth in claim 14 wherein said another sensor is positioned at an aft part of said coolant jacket including said outlet portion.

16. A method of determining an overheat condition of an internal combustion engine having at least one combustion chamber and at least one coolant jacket associated with a cooling system, said cooling system arranged to supply coolant through said coolant jacket for cooling a portion of said engine when said engine is running and where the coolant is drained from said coolant jacket when said engine is not running, a first sensor for sensing a temperature associated with said coolant jacket to output a first signal, and a second sensor for sensing a temperature associated with said coolant jacket to output a second signal, said method comprising sensing a temperature with said first sensor, sensing a temperature with said second sensor, determining if a temperature sensed by said first sensor exceeds a first predetermined temperature, determining if a temperature sensed by second sensor exceeds a second predetermined temperature, and outputting an overheat signal if at least one of the first and second sensed temperature exceeds said first or second predetermined temperature.

17. A method of determining an overheat condition as set forth in claim 16 wherein said coolant jacket has an inlet portion into which the coolant is introduced and an outlet portion from which the coolant is discharged, said first sensor is positioned at a fore part of said coolant jacket including said inlet portion, said second sensor is positioned at an aft part of said coolant jacket including said outlet portion, said method further comprises determining if an elapsed time exceeds a predetermined time after the engine is started, and outputting an overheat signal if a temperature sensed by said first sensor exceeds the first predetermined temperature and the elapsed time exceeds the predetermined time.

18. A method of determining an overheat condition as set forth in claim 17 wherein the predetermined time includes a time longer than a time that is necessary for said cooling system to supply coolant to said cooling jacket after said engine is started.

19. A method of determining an overheat condition as set forth in claim 16 wherein said method further comprises determining a rate of increase of the sensed first temperature, and outputting an overheat signal if the rate of increase exceeds a predetermined rate of increase.

20. A method of determining an overheat condition as set forth in claim 16 wherein said engine further has an ignition control system, and said method further includes preventing combustion in said combustion chamber when the overheat signal is output to said ignition control system.

* * * * *